US007524598B2

(12) United States Patent
Iwanaga et al.

(10) Patent No.: US 7,524,598 B2
(45) Date of Patent: Apr. 28, 2009

(54) ELECTROPHOTOGRAPHIC PHOTORECEPTOR, AND PROCESS CARTRIDGE AND IMAGE FORMING APPARATUS USING THE SAME

(75) Inventors: Takeshi Iwanaga, Kanagawa (JP); Shigeru Yagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 352 days.

(21) Appl. No.: 11/598,487

(22) Filed: Nov. 13, 2006

(65) Prior Publication Data

US 2007/0287085 A1 Dec. 13, 2007

(30) Foreign Application Priority Data

Jun. 7, 2006 (JP) ..... 2006-158508

(51) Int. Cl.
*G03G 15/04* (2006.01)

(52) U.S. Cl. ..... 430/66; 430/132; 430/109.1; 399/159

(58) Field of Classification Search ..... 430/66, 430/132, 109.1; 399/159
See application file for complete search history.

(56) References Cited

U.S. PATENT DOCUMENTS

| | | | |
|---|---|---|---|
| 6,180,309 | B1 | 1/2001 | Maty et al. |
| 2006/0013615 | A1 | 1/2006 | Nukada et al. |

FOREIGN PATENT DOCUMENTS

| | | |
|---|---|---|
| JP | 58-080647 | 5/1983 |
| JP | 62-280754 | 12/1987 |
| JP | 1-133063 | 5/1989 |
| JP | 01-229265 | 9/1989 |
| JP | 9-101625 | 4/1997 |
| JP | 2003-027238 | 1/2003 |

OTHER PUBLICATIONS

Research Group on Polymer Surface and Interface in The Society of Polymer Science, Japan: "Polymer Surface Technology" *Nikkan Kogyo Shimbun, Ltd.*, p. 213 (Aug. 28, 1987).

*Primary Examiner*—Mark A Chapman
(74) *Attorney, Agent, or Firm*—Fildes & Outland, P.C.

(57) ABSTRACT

Disclosed is an electrophotographic photoreceptor. The electrophotographic photoreceptor includes an organic photoreception layer that is formed on a conductive base and includes at least polycarbonate. An outermost surface of the organic photoreception layer has been subjected to surface treatment using plasma of gas including hydrogen, or hydrogen and nitrogen.

14 Claims, 10 Drawing Sheets

ELECTROPHOTOGRAPHIC PHOTORECEPTOR, AND PROCESS CARTRIDGE AND IMAGE FORMING APPARATUS USING THE SAME

BACKGROUND

1. Technical Field

The present invention relates to an electrophotographic photoreceptor used in an image forming apparatus, such as a photocopier that forms an image using an electrophotography method, to a process cartridge, and to an image forming apparatus.

2. Related Art

Recently, an electrophotography method has been extensively applied to an image forming apparatus, such as a photocopier or a printer. Since an electrophotographic photoreceptor (hereinafter, occasionally referred to as 'photoreceptor') that is used in the image forming apparatus using the electrophotography method is exposed to various types of contacts or stresses in the device, deterioration may occur. Meanwhile, high reliability is required in accordance with digitalization or colorization of the image forming apparatus.

Of the photoreceptors, currently, an organic photoreceptor is extensively used. The organic photoreceptor is inexpensive in comparison with the photoreceptor including amorphous silicon, and is better in view of safety in comparison with the photoreceptor including selenium or cadmium sulfide. However, since the organic photoreceptor has low hardness as compared to the photoreceptor including selenium or cadmium sulfide, if the organic photoreceptor is repeatedly used in the image forming apparatus, undesirably, abrasion may occur due to friction to a cleaning member or a developer. If the photoreceptor is abraded, there are problems in that a life is reduced and replacement is needed in a short cycle. Additionally, since surface roughness is increased due to the friction, slidability may deteriorate.

To avoid the above-mentioned problems, a hard film that is formed of diamond-like carbon (DLC), amorphous carbon nitride (CN), or amorphous silicon nitride may be formed on the organic photoreceptor as a surface protective layer.

However, if the surface protective layer having hardness significantly different from that of the organic photoreceptor is directly formed on the organic photoreceptor, problems, such as crevices, cracks, or stripping, may occur due to a difference in hardness.

Furthermore, in the photoreceptor having excellent surface wear resistance, such as the photoreceptor using amorphous silicon or the organic photoreceptor having the surface protective layer, such as DLC, in the case of when the photoreceptor is repeatedly used in a high humidity atmosphere, the surface of the photoreceptor has low resistance due to the substance stuck to the surface of the photoreceptor. Thus, blurring occurs or reduction in concentration occurs on an image.

The reason for this is believed that the discharge product stuck to the surface of the photoreceptor is reacted with water in air to reduce electric resistance of the surface. The typical organic photoreceptor does not suffer from the above-mentioned problem because the photoreceptor itself is worn to remove the stuck substance, such as the discharge product. However, when the hard surface layer is formed on the organic photoreceptor, the above-mentioned problem may occur.

In connection with this, it is known that if the surface of the polymer material is exposed to plasma, a crosslinking structure is formed on the surface of the polymer material, thus reforming the surface of the polymer material which is exposed to the plasma. In detail, treatment using plasma of various types of gases, such as inert gas including He or Ne, nitrogen, oxygen, or hydrogen has been performed. The effect obtained through the treatment depends on the plasma treatment condition, such as the type of gas. Examples of the effect include improvement in surface property, such as adhesion strength and hydrophilicity. Additionally, it is known that the crosslinking structure is formed by the plasma treatment to improve the surface hardness of the polymer material.

For example, it is known that if the surface of the polymer material is treated using plasma of organic silicon gas, Vickers hardness is improved with 10 to 30 times, surface resistance is reduced, and an erasing effect is assured.

As examples of the plasma treatment of the organic electrophotographic photoreceptor, there are surface treatment using plasma of fluorine compound gas to obtain water repellency and film formation surface treatment that is performed when a surface coating layer is formed to improve adhesion strength of the film. However, improvement in wear resistance of the electrophotographic photoreceptor using the plasma treatment has not been obtained. With respect to this, if the organic photoreceptor is directly exposed to plasma, properties of the photoreceptor may be reduced due to deterioration of a charge generation substance or a charge transport substance. Accordingly, there is the case where direct exposure of the organic photoreceptor to plasma is avoided.

SUMMARY

According to an aspect of the invention, there is provided an electrophotographic photoreceptor where an organic photoreception layer is formed on a conductive base. The organic photoreception layer includes at least polycarbonate, and an outermost surface of the organic photoreception layer has been subjected to surface treatment using plasma of gas containing hydrogen or hydrogen and nitrogen.

BRIEF DESCRIPTION OF THE DRAWINGS

Exemplary embodiments of the invention will be described in detail based on the following figures, wherein:

FIGS. 5A and 5B schematically illustrate measurement of volume resistance, in which FIG. 5A is a schematic plan view of a circular electrode and FIG. 5B is a schematic cross-sectional view of the circular electrode of FIG. 5A;

DETAILED DESCRIPTION

Figure 1:
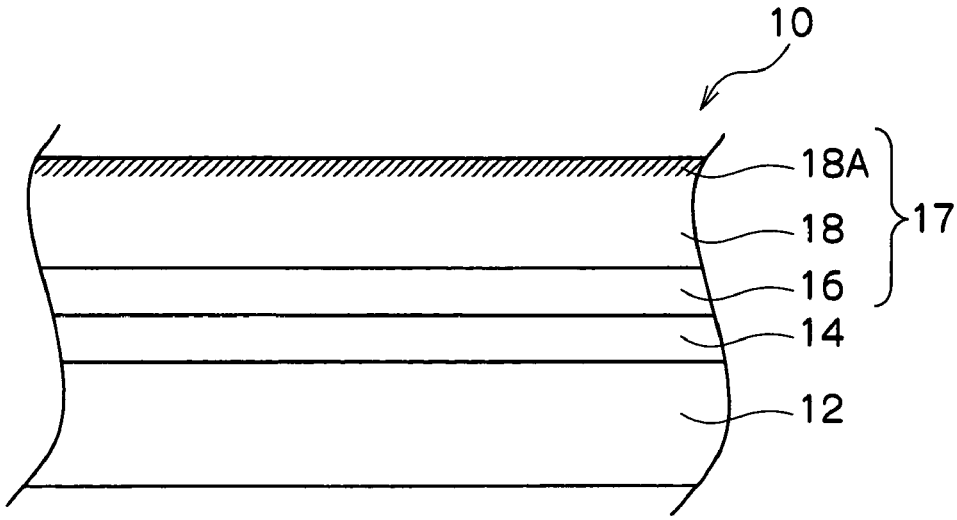
FIG. 1 is a cross-sectional view illustrating a layer structure of an electrophotographic photoreceptor of the invention.

Hereinafter, the invention will be described in detail.

<Electrophotographic Photoreceptor>

In an electrophotographic photoreceptor of the invention (hereinafter, occasionally referred to as 'photoreceptor'), an organic photoreception layer containing at least polycarbonate is formed on a conductive base. An outermost surface of the organic photoreception layer is treated using plasma of gas containing hydrogen or hydrogen and nitrogen.

The outermost surface of the organic photoreception layer of the electrophotographic photoreceptor is the most important portion to assure wear resistance, and to prevent occurrence of scratching and attachment of discharged products.

The electrophotographic photoreceptor of the invention is produced by treating the outermost surface of the organic photoreception layer containing at least polycarbonate using the plasma of the gas containing hydrogen or hydrogen and nitrogen.

The 'outermost surface' means a portion of the organic photoreception layer that is reformed, and a very thin layer ranging from the surface of the organic photoreception layer to the depth of several μm (in detail, from the surface to the depth of 0.01 to 3.0 μm). Substantially, the outermost surface means a layer corresponding to a portion measured in a depth direction when the solid surface is measured using XPS (X-ray photoelectron spectroscopy). Furthermore, the outermost surface has the thickness that ranges from the surface of the organic photoreception layer to the depth of, preferably 0.01 μm or more, and more preferably 0.05 μm or more. If the outermost surface that is reformed at the depth of 3 μm or more is present, electric properties, such as sensitivity, residual potential, and repetition are poor.

Further, the outermost surface of the invention is not a layer that has an apparent interface as those of a coating layer or a deposition layer, but a portion that has the variable composition in the range of from the surface to a predetermined depth shown in a microscopic picture as described later.

Hereinafter, the outermost surface may be referred to as 'reformed layer' for description.

If the outermost surface of the organic photoreception layer containing at least polycarbonate is treated using the plasma of hydrogen or the plasma of mixture gas of hydrogen and nitrogen, the treated outermost surface (reformed layer) has the reduced peak that means absorption at 1770 $cm^{-1}$ due to the carbonate bond and the increased absorption at 1650 to 1750 $cm^{-1}$ in the IR absorption spectrum as compared to the outermost surface that is not treated using the plasma. The reason for this is believed that the carbonate bond is broken to form a crosslink structure on the outermost surface of the organic photoreception layer.

The measurement of the spectrum is preferably performed using an attenuated total reflection method (IR absorption spectrum ATR method). Since the ATR method is highly sensitive with respect to the surface state, it is possible to highly sensitively detect the chemical bond change on the surface using the ATR method.

As described above, the outermost surface of the organic photoreception layer of the electrophotographic photoreceptor is treated using the plasma of the gas containing hydrogen or hydrogen and nitrogen to break the polycarbonate bond contained in the organic photoreception layer, thus forming the crosslink structure. Thereby, the outermost surface of the organic photoreception layer is hardened to form the reformed layer.

Therefore, the electrophotographic photoreceptor of the invention has excellent wear resistance at a surface thereof.

Additionally, since the outermost surface of the electrophotographic photoreceptor of the invention that is treated using the plasma is a region that is formed by reforming a portion of the organic photoreception layer, the outermost surface has excellent adhesion strength to the conductive base and the non-reformed region of the organic photoreception layer. Thus, the problem, such as stripping, does not occur. Accordingly, when the photoreceptor is mounted on an electrophotographic image forming apparatus, stripping does not occur even though friction occurs due to a cleaning system or a transferring system. Further, since low friction surface may be maintained and attachment of the discharged product to the outermost surface may be suppressed, the occurrence of image defect may be suppressed. Additionally, since mechanical durability is excellent, it is easy to desirably maintain the above-mentioned characteristics for a long time.

If the outermost surface of the organic photoreception layer is treated using the plasma of hydrogen or the plasma of mixture gas of hydrogen and nitrogen, an oxygen element content of the outermost surface (reformed layer) of the organic photoreception layer after the surface treatment is increased with 0.1 to 20 atom %, and preferably 1 to 15 atom %, as compared to the case of before the surface treatment is performed.

If the increase in oxygen content is less than 0.1 atom %, it may be difficult to desirably form the crosslink structure. Accordingly, a surface portion (outermost surface) of the charge transport layer may be undesirably hardened. If the increase in content exceeds 20 atom %, charge transport properties of the charge transport layer may be reduced. Furthermore, a concentration distribution of oxygen element may be uniform or nonuniform in view of the thickness of the outermost surface.

In the outermost surface of the photoreception layer, the content of oxygen element may be obtained using the XPS (X-ray photoelectron spectroscopy).

In detail, for example, JPS9010MX (manufactured by JEOL Ltd.) is used, MgKα is used as an X-ray source, and radiation is performed with 10 kV and 20 mA. Measurement of a photoelectron is performed at a 1 eV step. With respect to the amount of element, the 1s spectrum of a fluorine element and a nitrogen element is measured, and the amount of element is obtained using surface intensity of the spectrum and a sensitivity factor. Additionally, Ar ion etching is performed at 500 V for 10 s before the measurement.

With respect to the contents of elements of the photoreceptor surface, a secondary electron mass spectrometry method or a Rutherford backscattering method may be used in addition to the XPS.

The increased content of the nitrogen element or the fluorine element after the surface treatment may be confirmed using XPS analysis results of the surface before and after the surface of the photoreception layer is ground using a grinding agent to the depth of about 5 μm with respect to the photoreceptor that is subjected to surface treatment.

It is preferable that a surface coating layer be layered on the treated surface of the organic photoreception layer. The reformed layer that is formed by reforming and curing a portion of the organic photoreception layer using plasma treatment of hydrogen or mixture gas of hydrogen and nitrogen has excellent wear resistance. However, it is possible to further improve wear resistance by forming the surface coating layer having hardness higher than that of the reformed layer.

As described above, if the reformed layer that is hardened by the treatment using the plasma of hydrogen or the plasma of mixture gas of hydrogen and nitrogen acts as a growth surface, and if the surface coating layer that is harder than the reformed layer is formed on the hardened reformed layer, hardness is stepwise or continuously increased moving from the nonreformed region of the organic photoreception layer through the reformed layer to the surface coating layer. Accordingly, problems, such as stripping and cracks, which are caused by a difference in hardness of the organic photoreception layer and the surface coating layer may be avoided.

It is preferable that the surface coating layer have high water repellency and the high water repellency be maintained for a long time even though the surface coating layer be repeatedly used as the electrophotographic photoreceptor. Since the surface coating layer has the above-mentioned characteristics, even though the electrophotographic photoreceptor having the surface coating layer that is mounted on the electrophotographic image forming apparatus is repeatedly used in a high humidity environment, it is possible to produce an image having high resolution.

Preferably, when the electrophotographic photoreceptor having the surface coating layer is mounted on the electrophotographic image forming apparatus, it is preferable that the surface coating layer have excellent lubrication. Since the surface coating layer has the above-mentioned characteristics, it is possible to suppress friction resistance to the cleaning member.

In order to satisfy the above-mentioned characteristics, it is preferable that the surface coating layer contains group 13 element shown in a periodic table and nitrogen. Of the elements, the surface coating layer that is formed of a thin film containing any one or both of Ga and Al which are the group 13 element is advantageous in that it is possible to control electric conductive property by addition of impurities, chemical stability is high, wear resistance is excellent due to high hardness, the surface of the layer oxidized through natural oxidation has the high water repellency, the water repellency is not reduced, and lubrication is excellent when the layer is used as the electrophotographic photoreceptor.

Even after the surface coating layer that contains the group 13 element and nitrogen is left in the air, or even after the surface coating layer is used as the electrophotographic photoreceptor, the water repellency is excellent. Furthermore, when the layer is used as the electrophotographic photoreceptor, the lubrication is poor at an early step as compared to the organic photoreceptor on which the surface coating layer is not formed, but the lubrication is significantly improved after the use of layer is repeated.

It is preferable that the thickness of the surface coating layer be 0.01 to 3.0 μm. More preferably, the thickness is 0.05 to 0.5 μm.

If the thickness of the surface coating layer is 0.01 μm or less, there is a problem in that wear resistance is not improved. If the thickness is 3.0 μm or more, electric properties, such as sensitivity, residual potential, and repetition, are poor.

Hereinafter, a description will be given of construction of the electrophotographic photoreceptor of the invention.

The photoreceptor of the invention is not limited as long as the photoreceptor has a structure where the photoreception layer including the organic photoreception layer is formed on the conductive base. An undercoat layer may be formed between the organic photoreception layer and the conductive base if necessary. Additionally, the organic photoreception layer may include two or more layers, or be a function separation type. Hereinafter, embodiments of layer construction of the photoreceptor according to the invention will be described in detail with reference to the drawings.

FIG. 1 is a cross-sectional view illustrating a layer structure of an electrophotographic photoreceptor 10 of the invention. The electrophotographic photoreceptor 10 includes an undercoat layer 14 and an organic photoreception layer 17 that are layered on a conductive base 12.

The organic photoreception layer 17 includes a charge transport layer 18 that is layered on a charge generation layer 16, and the outermost surface of the charge transport layer 18 acts as a reformed layer 18A that is formed by treating the outermost surface of the charge transport layer 18 (the outermost surface or the organic photoreception layer 17) using the plasma of gas containing hydrogen or hydrogen and nitrogen.

Additionally, FIG. 1 illustrates the electrophotographic photoreceptor 10 of the invention that includes the undercoat layer 14 and the organic photoreception layer 17 that are layered on the conductive base 12. However, the organic photoreception layer 17 may be directly layered on the conductive base 12, or the organic photoreception layer having the functions of the charge generation layer 16 and charge transport layer 18 shown in FIG. 1 may be formed on the conductive base 12. In addition, in the invention, the synthesis of an organic photoreception layer (not shown) where the organic photoreception layer 17, the charge generation layer 16, and the charge transport layer 18 shown in FIG. 1 are integrated, and the undercoat layer 14 that is formed if necessary is referred to as the photoreception layer.

Furthermore, in FIG. 1, in the organic photoreception layer 17, the charge transport layer 18 is layered on the charge generation layer 16. However, the charge generation layer 16 may be layered on the charge transport layer 18. In this case, the outermost surface of the charge generation layer 16 acts as the reformed layer 18A.

Figure 2:
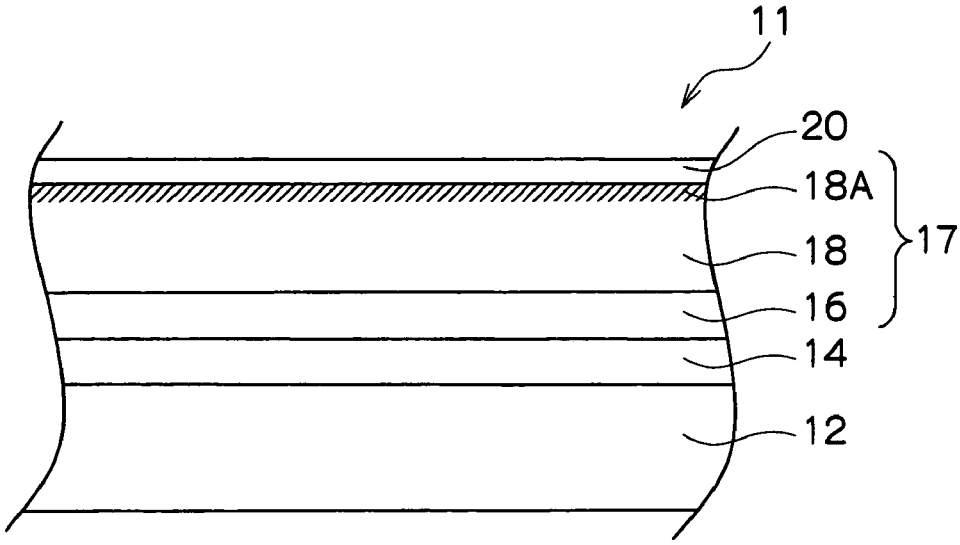
FIG. 2 is a cross-sectional view illustrating a layer structure of an electrophotographic photoreceptor of the invention.

As shown in FIG. 2, it is preferable that the electrophotographic photoreceptor 11 of the invention include a surface coating layer 20 additionally layered on the organic photoreception layer 17 shown in FIG. 1.

The surface of the charge transport layer 18, that is, the surface of the organic photoreception layer 17, is treated using the plasma of the gas containing hydrogen or hydrogen and nitrogen to produce the electrophotographic photoreceptor of the invention. Surface treatment will be described.

(Surface Treatment)

In the surface treatment of the organic photoreception layer, a direct current, an alternating current, a high frequency, and microwave plasma may be used. With respect to a device, a plasma CVD device or a remote plasma device of a parallel flat type of electrode or a cylindrical type of electrode may be used. Hereinafter, the embodiment of the device used in the surface treatment will be described referring to the drawings.

Figure 3:
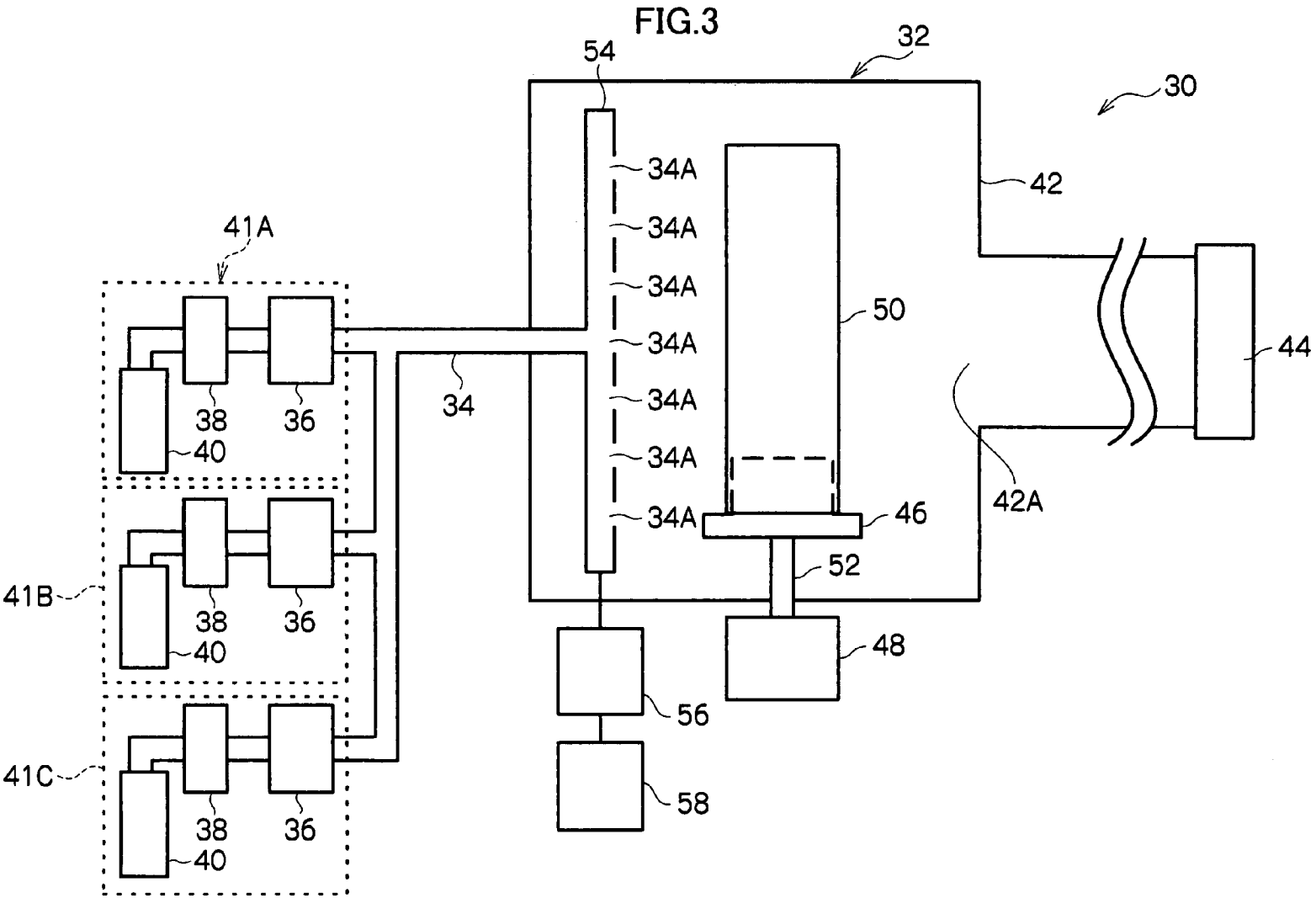
FIG. 3 illustrates a surface treatment device of the invention.

FIG. 3 schematically illustrates the surface treatment device that is used in the surface treatment of the organic photoreceptor according to the invention.

A surface treatment device 30 includes a vacuum chamber 32 for vacuum exhaustion.

In the vacuum chamber 32, a support member 46 is provided to rotatably support an electrophotographic photoreceptor 50 which is not subjected to surface treatment (hereinafter, referred to as 'untreated photoreceptor') so that a longitudinal axis of the untreated photoreceptor 50 is identical to a rotation axis. The support member 46 is connected through a support shaft 52 for supporting the support member 46 to a motor 48, and a driving force of the motor 48 is capable of being transferred through the support shaft 52 to the support member 46.

After the untreated photoreceptor 50 is supported by the support member 46, the motor 48 is driven to transfer the driving force of the motor 48 through the support shaft 52 and the support member 46 to the untreated photoreceptor 50, thus rotating the untreated photoreceptor 50 while the longitudinal axis is identical to the rotation axis.

An exhaust pipe 42 is formed at an end of the vacuum chamber 32 to exhaust gas from the vacuum chamber 32. The exhaust pipe 42 communicates with the vacuum chamber 32 through an opening 42A of the vacuum chamber 32 at an end thereof, and is connected to a vacuum exhaust unit 44 at another end thereof. The vacuum exhaust unit 44 includes one or a plurality of vacuum pumps. However, the vacuum exhaust unit may include a unit for controlling an exhaust rate, such as a conductance valve, if necessary.

If air is exhausted from the vacuum chamber 32 through the exhaust pipe 42 using the driving of the vacuum exhaust unit 44, an internal pressure of the vacuum chamber 32 is reduced to a predetermined pressure. The predetermined pressure may be the pressure capable of generating plasma in the vacuum chamber 32 as described later, and depends on the type of gas, supplied power, and the frequency of an electric source. In detail, it is preferable that the pressure be 1 to 200 Pa.

A discharge electrode 54 is formed in the vicinity of the untreated photoreceptor 50 which is provided in the vacuum chamber 32. The discharge electrode 54 is electrically connected through a matching box 56 to a high frequency electric source 58. A direct current electric source or an alternating current electric source may be used as the electric source, and it is preferable to use the high frequency electric source of the alternating current because gas is efficiently excited.

The discharge electrode 54 has a plate shape, and is provided so that a longitudinal-axis direction of the discharge electrode 54 is identical to a rotation-axis direction (longitudinal-axis direction) of the untreated photoreceptor 50. The discharge electrode 54 is spaced from an external circumferential surface of the untreated photoreceptor 50. The discharge electrode 54 has a hollow structure (cave shape), and one or a plurality of openings 34A in a discharge side thereof to feed gas for generating plasma. If the discharge electrode 54 does not have the cave shape and the openings 34A on the discharge side thereof, the gas for generating the plasma is fed through a gas inlet that is separately formed, and flows between the untreated photoreceptor 50 and the discharge electrode 54. Additionally, in order to prevent the occurrence of discharge between the discharge electrode 54 and the vacuum chamber 32, it is preferable that an earthed member cover an electrode side other than a side facing the untreated photoreceptor 50 while a clearance of about 3 mm or less is left.

If high frequency power is supplied from the high frequency electric source 58 through the matching box 56 to the discharge electrode 54, the discharge is caused by the discharge electrode 54.

A gas feeding pipe 34 is formed in a region that faces the untreated photoreceptor 50 so that the discharge electrode 54 is provided between the region and the untreated photoreceptor in the vacuum chamber 32, thus feeding gas through the hollow discharge electrode 54 to the untreated photoreceptor 50 in the vacuum chamber 32.

The gas feeding pipe 34 communicates with the discharge electrode 54 at an end thereof (that is, the gas feeding pipe communicates with the vacuum chamber 32 through the discharge electrode 54 and the openings 34A), and is connected to a gas feeder 41A, a gas feeder 41B, and a gas feeder 41C at another end thereof.

The gas feeder 41A, the gas feeder 41B, and the gas feeder 41C each include an MFC (mass flow controller) 36 for controlling a feed rate of the gas, a pressure controller 38, and a gas feeding source 40. The gas feeding sources 40 of the gas feeder 41A, the gas feeder 41B, and the gas feeder 41C are connected through the pressure controllers 38 and the MFCs 36 to another end of the gas feeding pipe 34.

While a feeding pressure of the gas is controlled by the pressure controller 38 and the feeding rate of the gas is controlled by the MFC 36, the gas is fed from the gas feeding source 40 through the gas feeding pipe 34, the discharge electrode 54, and the openings 34A to the untreated photoreceptor 50 of the vacuum chamber 32.

Additionally, the types of gases that are charged in the gas feeding sources 40 provided in the gas feeder 41A, the gas feeder 41B, and the gas feeder 41C may be the same. However, in the case of when treatment is performed using a plurality of types of gases, the gas feeding sources 40 where different types of gases are charged may be used. In this case, different types of gases are fed from the gas feeding sources 40 of the gas feeder 41A, the gas feeder 41B, and the gas feeder 41C to the gas feeding pipe 34 to form a mixture gas, and the mixture gas is fed through the discharge electrode 54 and the openings 34A to the untreated photoreceptor 50 in the vacuum chamber 32.

Additionally, FIG. 3 shows a capacitance type of discharge using the discharge electrode 54. However, an inductance type may be used.

For example, the surface treatment may be performed through the following procedure. First, the internal pressure of the vacuum chamber 32 is reduced to the predetermined pressure using the vacuum exhaust unit 44. And then, $H_2$ gas, or a mixture gas containing $N_2$ and $H_2$ is fed from the gas feeding pipe 34 to the vacuum chamber 32. After that, high frequency power is supplied from the high frequency electric source 58 through the matching box 56 to the discharge electrode 54. In connection with this, the plasma of the gas containing hydrogen or hydrogen and nitrogen is formed so as to radially spread from the discharge side of the discharge electrode 54 to the opening 42A of the exhaust pipe 42.

Furthermore, it is preferable that the pressure in the vacuum chamber 32 be 1 to 500 Pa during the formation of the plasma.

In the invention, in the case of when the mixture gas of the hydrogen gas and the nitrogen gas is fed to the vacuum chamber 32, it is preferable that a mixing ratio (nitrogen gas/hydrogen gas) of the mixing gas in the vacuum chamber 32 be 100 or less. Further, in the both cases of when the hydrogen gas is fed to the vacuum chamber 32 and the mixture gas containing hydrogen and nitrogen is fed to the vacuum chamber 32, it is preferable that a flow rate of the gas fed to the vacuum chamber 32 be 10 sccm or more in view of a treatment rate.

The surface temperature of the untreated photoreceptor 50 is not limited during the surface treatment. However, it is preferable to perform the treatment at 0° C. or higher to 150° C. or lower. Furthermore, in the case of when the surface treatment is performed, it is preferable that the surface temperature of the untreated photoreceptor 50 be 100° C. or less. In the case of when the surface temperature is higher than 150° C. due to the plasma even though the temperature of the untreated photoreceptor 50 is 150° C. or less, the organic photoreception layer may be damaged by heat. Thus, it is preferable to set the temperature of the untreated photoreceptor 50 in consideration of the above-mentioned fact.

Additionally, the temperature of the untreated photoreceptor 50 may be controlled using a method not shown, or a natural increase in temperature during the discharging may be used. In the case of when the untreated photoreceptor 50 is heated, a heater may be provided out of the untreated photoreceptor 50 or in the untreated photoreceptor. In the case of when the untreated photoreceptor 50 is cooled, cooling gas or liquid may circulate in the untreated photoreceptor 50.

In order to avoid an increase in temperature of the untreated photoreceptor 50 due to the discharge, it is preferable to control the flow of gas that comes into contact with the surface of the untreated photoreceptor 50 and has high energy. In connection with this, conditions, such as the flow rate of gas, a discharge output, and a pressure, may be adjusted to obtain the desired temperature.

In the method of generating the plasma using the surface treatment device 30 shown in FIG. 3, a high frequency oscillation device is used, but the device is not limited thereto. For example, a microwave oscillation device may be used, or an electro-cyclotron resonance type or helicon plasma type of device may be used. Furthermore, the high frequency oscillation device may be an inductance type or a capacitance type.

In the invention, the plasma generating device includes the discharge electrode 54, the high frequency electric source 58, the matching box 56, the gas feeding pipe 34, the MFC 36, the pressure controller 38, and the gas feeding source 40, and one plasma generating device is used. However, two or more types of plasma generating devices may be used in combination, or two or more devices that are the same type may be used. Additionally, a capacitance combination type of plasma CVD device where a cylindrical electrode surrounds the cylindrical untreated photoreceptor 50 may be used, or a device where the discharge occurs between the parallel plate electrode and the untreated photoreceptor 50 may be used.

In the case of when two or more plasma generating devices that are different types are used, it is necessary to simultaneously form discharges using the same pressure. Furthermore, a difference in pressure may be formed in a discharge region and a surface treatment region (on which the untreated photoreceptor 50 is provided). The devices may be disposed in series with respect to the gas flow ranging from a gas inlet to a gas outlet in the treatment device, or the devices may be disposed so as to face the treatment surface of the untreated photoreceptor 50.

In the invention, for example, in the case of when the discharge occurs using the high frequency discharge, it is preferable that the frequency be 10 kHz to 50 MHz to obtain the hard reformed layer having low surface energy. Furthermore, the output depends on the area of the untreated photoreceptor to be subjected to surface treatment, and is preferably 10 to 2,000 W. The treatment time depends on the desired degree of reformation, and is preferably 1 to 60 min.

Preferably, the output per the surface 1 $cm^2$ of the untreated photoreceptor 50 as a surface treatment object provided in the vacuum chamber 32 is 10 Wh or less. The output is set to 10 Wh or less to prevent deterioration of the charge generation substance or the charge transport substance contained in the organic photoreception layer using the plasma treatment. In the plasma treatment using the hydrogen gas or the mixture gas of hydrogen and nitrogen, it is possible to perform desirable hardening while properties of the organic photoreception layer are prevented from being reduced using the above-mentioned amount of power. If the treatment is performed using the amount of power of 10 Wh or more per 1 $cm^2$, properties required as the photoreceptor may deteriorate, causing the poor quality of image.

Furthermore, the discharge may be performed at an atmospheric pressure or so. In connection with this, the term 'atmospheric pressure or so' means the range of from 70,000 to 110,000 Pa. Additionally, if He or Ar gas that is rare gas is used to generate the discharge while being mixed with hydrogen, it is easy to achieve stabilization of the discharge.

The untreated photoreceptor 50 is subjected to the surface treatment using the plasma of the gas containing hydrogen or hydrogen and nitrogen to reform the outermost surface of the organic photoreception layer 17, thereby producing the electrophotographic photoreceptor 10 having the hardened reformed layer according to the invention.

Since the photoreceptor where the reformed layer is formed in the outermost surface is hard and has excellent wear resistance, it is possible to maintain a flat surface even after its use is repeated. Thus, slidability is high and friction is low with respect to a cleaning blade.

The water repellency may be measured using a water contact angle. The water contact angle of the surface of the photoreceptor according to the invention is preferably 40 degrees or more, and more preferably 70 degrees or more.

3.1 μl of pure water is dropped on a surface of a cylindrical core, and the water contact angle of the surface is obtained in an atmosphere having RH of 50% at 25° C. using a contact angle meter (trade name: CA-X, manufactured by Kyowa Interface Science Co., Ltd.) after 15 sec. Additionally, measurement is performed at an end and four points around the center, and an average thereof is evaluated as the contact angle.

Furthermore, the term 'water contact angle' means the contact angle of distilled water at 25° C. through the specification.

Figure 4:
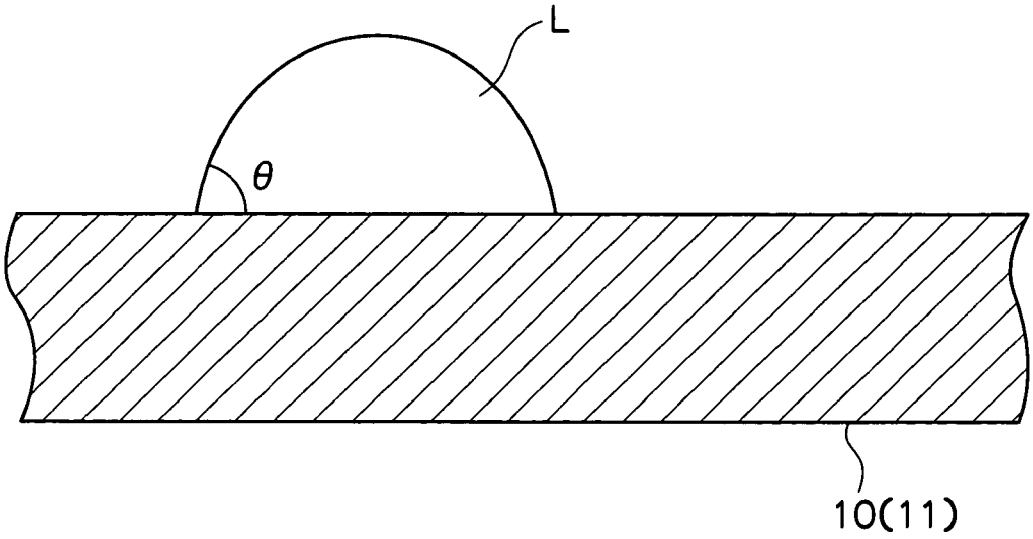
FIG. 4 illustrates a water contact angle θ measured in the invention.

The measurement of the contact angle of distilled water to the electrophotographic photoreceptor at 25° C. will be described referring to FIG. 4. FIG. 4 illustrates the measurement of the contact angle of distilled water to the surface of the electrophotographic photoreceptor at 25° C., and is a cross-sectional view showing that distilled water is dropped on the surface of the electrophotographic photoreceptor 10 or the electrophotographic photoreceptor 11. As shown in FIG. 4, a portion of the liquid drop is provided on the surface of the electrophotographic photoreceptor 10 or the electrophotographic photoreceptor 11 to form a drop of distilled water L on the electrophotographic photoreceptor 10 or the electrophotographic photoreceptor 11. An optical microscope picture of the liquid drop L is photographed. The contact angle θ of distilled water L to the upper part of the electrophotographic photoreceptor 10 or the electrophotographic photoreceptor 11 at 25° C. is obtained using the picture.

(Conductive Base, Organic Photoreception Layer, and Surface Coating Layer)

Next, a detailed description will be given of the conductive base and the organic photoreception layer constituting the electrophotographic photoreceptor according to the invention. Furthermore, a detailed description will be given of the undercoat layer and the surface coating layer formed on the organic photoreception layer that is subjected to surface treatment in the case of when the electrophotographic photoreceptor of the invention is the organic photoreceptor having the function separation type of organic photoreception layer.

Examples of the conductive base 12 include a drum made of metal, such as aluminum, copper, iron, stainless steel, zinc, and nickel; a base where metal, such as aluminum, copper, gold, silver, platinum, palladium, titanium, nickel-chromium, stainless steel, and copper-indium, is deposited on a base material, such as sheet, paper, plastic, and glass; a base where a conductive metal compound, such as indium oxide and tin oxide, is deposited on the base material; a base where metal foil is laminated on the base material; and a base where carbon black, indium oxide, tin oxide-antimony oxide powder, metal powder, or copper iodide is dispersed in a binder resin and then applied on the base material for conductive treatment. Furthermore, the shape of conductive base 12 may be any one of a drum, a sheet, and a plate.

Additionally, in the case of when a metal pipe base is used as the conductive base 12, the surface of the metal pipe base may be not subjected to surface treatment, or the surface of the base may be roughened by the surface treatment in advance. In the case of when a coherent light source, such as a laser beam, is used as an exposure light source, non-uniformity of concentration that forms grains and is caused by interference light in the photoreceptor may be prevented due to the roughening. Examples of the surface treatment process include mirror-surface cutting, etching, anodizing, rough cutting, centerless grinding, sand blast, and wet honing.

Preferably, an aluminum base that is subjected to anodizing at a surface thereof is preferably used as the conductive base 12 in consideration of improvement in close adhesion to the organic photoreception layer 17 and in film forming.

Hereinafter, a description will be given of the method of producing the conductive base 12 that is subjected to anodizing at the surface thereof.

First, pure aluminum or an aluminum alloy (for example, JIS 1000s, 3000s, or 6000s of aluminum or aluminum alloy) is prepared as a base. Next, the anodizing is performed. The anodizing is performed in an acid bath including a chromic acid, a sulfuric acid, an oxalic acid, a phosphoric acid, a boric acid, or a sulfamic acid, and the treatment using the sulfuric acid bath is frequently performed. For example, the anodizing is performed under the condition that includes but is not limited to a sulfuric acid concentration of 10 to 20 mass %, a bath temperature of 5 to 25° C., current density of 1 to 4 $A/dm^2$, electrolytic voltage of 5 to 30 V, and a treatment time of 5 to 60 min.

Since the anodizing film that is formed on the aluminum base through the above-mentioned procedure is porous and has high insulation and a very unstable surface, physical properties of the film may be easily changed with time after the film is formed. To prevent the physical properties from being changed, holes of the anodizing film are clogged. Examples of the clogging process include a process of immersing an anodizing film in an aqueous solution containing nickel fluoride or nickel acetate, a process of immersing an anodizing film in boiled water, and a treatment process using pressurized steam. Of the processes, the process of immersing the film in the aqueous solution containing nickel acetate is most frequently used.

The excessive amount of metal salts that are attached during the clogging of the holes remains on the surface of the anodizing film after the holes of the film are clogged. The excessive amount of metal salts that is present on the anodizing film of the base negatively affects the quality of coating layer formed on the anodizing film. Additionally, since components having low resistance tend to remain, if the base is applied to the photoreceptor to form the image, base pollution may occur.

In a subsequent process of the clogging of the holes, the anodizing film is washed to remove the metal salts attached during the clogging of the holes. The base may be washed using pure water once, but it is preferable to wash the base through a multi-stage washing process. In connection with this, a clean washing solution (deionized) is used in the final washing stage. Additionally, it is more preferable that physical rubbing washing be performed using a contact member, such as a brush, in any one stage of the multi-stage washing process.

Preferably, the anodizing film of the surface of the conductive base 12 is 3 to 15 μm in thickness. A barrier layer is provided on the anodizing film along the porous top surface of the porous anodizing film. It is preferable that the thickness of the barrier layer be 1 to 100 nm in the photoreceptor of the invention. Through the above-mentioned procedure, the conductive base 12 that is subjected to the anodizing is obtained.

In the conductive base 12, the anodizing film which is formed on the base using the anodizing has high carrier blocking property. Accordingly, it is possible to prevent point defect (black point, base contamination) in the case of when the photoreceptor using the conductive base is mounted on the image forming apparatus to achieve a reversal development (negative and positive development). Additionally, it is possible to prevent current leakage from a contact charging device that easily occurs during the contact charging. Furthermore, the holes of the anodizing film are clogged to prevent the physical properties from being changed with time after the anodizing film is produced. Further, the conductive base may be washed after the clogging of the holes to remove the metal salts attached to the surface of the conductive base due to the clogging of the holes. In the case of when an image is formed using the image forming apparatus having the photoreceptor produced using the conductive base 12, the occurrence of base pollution may be desirably prevented.

Next, a description will be given of the undercoat layer 14 formed on the conductive base 12 if necessary.

Examples of the material constituting the undercoat layer 14 include an acetal resin, such as polyvinyl butyral; a polymer resin compound, such as a polyvinyl alcohol resin, casein, a polyamide resin, a cellulose resin, gelatin, a polyurethane resin, a polyester resin, a methacryl resin, an acryl resin, a polyvinyl chloride resin, a polyvinyl acetate resin, a vinyl chloride-vinyl acetate-maleic anhydride resin, a silicon resin, a silicon-alkyd resin, a phenol-formaldehyde resin, and a melamine resin; and an organometallic compound containing zirconium, titanium, aluminum, manganese, and a silicon atom.

The above-mentioned compounds may be used alone, or in a mixture or polycondensate form of a plurality of compounds. Of the compounds, since the organometallic compound containing zirconium or silicon has a low residual potential, a change in potential due to the environment and the repeated use is small. Accordingly, the organometallic compound is preferable. Furthermore, the organometallic compound may be used alone or in a form of mixture thereof. Additionally, the organometallic compound may be used while being mixed with the binder resin as described later.

Examples of the organic silicon compound (the organometallic compound containing the silicon atom) include vinyltrimethoxysilane, γ-methacryloxypropyl-tris(β-methoxyethoxy)silane, β-(3,4-epoxycyclohexyl) ethyltrimethoxysilane, γ-glycidoxypropyltrimethoxysilane, vinyltriacetoxysilane, γ-mercaptoproyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Of them, it is preferable to use a silane coupling agent including vinyl-triethoxysilane, vinyltris(2-methoxyethoxysilane), 3-methacryloxypropyltrimethoxysilane, 3-glycidoxypropyltrimethoxysilane, 2-(3,4-epoxycyclohexyl)ethyltrimethoxysilane, N-2-(aminoethyl)-3-aminopropyltrimethoxysilane, N-2-(aminoethyl)-3-aminopropylmethyldimethoxysilane, 3-aminopropyltriethoxysilane, N-phenyl-3-aminopropyltrimethoxysilane, 3-mercaptopropyltrimethoxysilane, or 3-chloropropyltrimethoxysilane.

Examples of the organic zirconium compound (the organometallic compound containing zirconium) include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the organic titanium compound (the organometallic compound containing titanium) include tetraisopropyl titanate, tetra-n-butyl titanate, butyl titanate dimer, tetra (2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxytitanium stearate.

Examples of the organic aluminum compound (the organometallic compound containing aluminum) include aluminum isopropylate, monobutoxyaluminum diisopropylate, aluminum butylate, diethylacetoacetate aluminum diisopropylate, and aluminum tris(ethylacetoacetate).

Furthermore, examples of the solvent that is applied to a coating solution to form the undercoat layer 14 include a known organic solvent, for example, an aromatic hydrocarbon-based solvent, such as toluene and chlorobenzene, an aliphatic alcohol-based solvent, such as methanol, ethanol, n-propanol, iso-propanol, and n-butanol, a ketone-based solvent, such as acetone, cyclohexanone, and 2-butanone, a halogenated aliphatic hydrocarbon solvent, such as methylene chloride, chloroform, and ethylene chloride, a cyclic- or straight chain-type ether-based solvent, such as tetrahydrofuran, dioxane, ethylene glycol, and diethyl ether, and an ester-based solvent, such as methyl acetate, ethyl acetate, and n-butyl acetate. The solvents may be used alone, or two or more types of solvents may be used while being mixed with each other. Any solvent may be used as the solvent used in the case of when two or more types of solvents are mixed with each other as long as the solvent is capable of dissolving the binder resin in the solvent mixture form.

The coating agent for the undercoat layer and the solvent are dispersed and mixed to produce a coating solution for forming the undercoat layer. The coating solution is applied on the surface of the conductive base to form the undercoat layer 14. Examples of the process of applying the coating solution for forming the undercoat layer include a typical process, such as an immersion coating process, a ring coating process, a wire bar coating process, a spray coating process, a blade coating process, a knife coating process, and a curtain coating process. In the case of when the undercoat layer is formed, it is preferable that the thickness of the layer be 0.1 to 3 μm. The thickness of the undercoat layer is set to be in the above-mentioned range to prevent an increase in potential caused by desensitization and repeated use while an electric barrier is not very strongly formed.

Through the above-mentioned procedure, the undercoat layer 14 is formed on the conductive base to improve wettability during the formation of the layer applied on the undercoat layer and to desirably act as an electric blocking layer.

Surface roughness of the undercoat layer 14 may be controlled to be 1/(4n) to 1 times as high as the wavelength λ of the laser for exposure (wherein, n is a refractive index of the layer formed outside of the undercoat layer). The surface roughness is controlled by adding resin particles to the coating solution for the undercoat layer. In the case of when the photoreceptor produced while the surface roughness of the undercoat layer is controlled is used in an image forming apparatus, it is possible to desirably prevent an interference fringe image due to a laser light source.

Furthermore, silicon resin particles and crosslink-type PMMA resin particles may be used as the resin particles. Additionally, the surface of the undercoat layer may be ground to control the surface roughness. Examples of the grinding process include buff grinding, sand blast processing, wet honing, and grinding treatment. In the photoreceptor that is used in the positive charging type of image forming apparatus, laser incident light is absorbed in the vicinity of the top surface of the photoreceptor and scattered in the photoreception layer. Accordingly, the surface roughness of the undercoat layer is not necessarily controlled.

It is preferable to add various types of additives to the coating solution for forming the undercoat layer in order to improve electric properties, environmental safety, and the quality of image. Examples of the additives include an electron transport substance that includes a quinone-based compound, such as chloranyl, bromoanil, and anthraquinone, a tetracyanoquinodimethane-based compound, a fluorenone compound, such as 2,4,7-trinitrofluorenone and 2,4,5,7-tetranitro-9-fluorenone, an oxadiazol-based compound, such as 2-(4-biphenyl)-5-(4-t-butylphenyl)-1,3,4-oxadiazole, 2,5-bis(4-naphthyl)-1,3,4-oxadiazole, and 2,5-bis(4-diethyl aminophenyl)1,3,4 oxadiazole, a xanthone-based compound, a thiophene compound, and a diphenoquinone compound, such as 3,3',5,5'-tetra-t-butyldiphenoquinone, an electron transport pigment, such as polycyclic condensates and azos, and a known material, such as a zirconium chelate compound, a titanium chelate compound, an aluminum chelate compound, a titanium alkoxide compound, an organic titanium compound, and a silane coupling agent.

Specific examples of the silane coupling agent include, but are not limited to vinyltrimethoxysilane, γ-methacryloxypropyl-tris(β-methoxyethoxy)silane, β-(3,4-epoxycyclohexyl) ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

Specific examples of the zirconium chelate compound include zirconium butoxide, zirconium ethyl acetoacetate, zirconium triethanolamine, acetylacetonate zirconium butokide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Specific examples of the titanium chelate compound include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxytitanium stearate.

Specific examples of the aluminum chelate compound include aluminum isopropylate, monobutoxyaluminum diisopropylate, aluminum butylate, diethylacetoacetate aluminum diisopropylate, and aluminum tris(ethylacetoacetate).

The above-mentioned additives may be used alone, or in a mixture or polycondensate form of a plurality of compounds.

Additionally, it is preferable that the above-mentioned coating solution for forming the undercoat layer contain at least one type of electron accepting substance. Specific examples of the electron accepting substance include a succinic anhydride, a maleic anhydride, a dibrom maleic anhydride, a phthalic anhydride, a tetrabromophthalic anhydride, tetracyanoethylene, tetracyanoquinodimethane, o-dinitrobenzene, m-dinitrobenzene, chloranyl, dinitroanthraquinone, trinitrofluorenone, a picric acid, an o-nitrobenzoic acid, a p-nitrobenzoic acid, and a phthalic acid. Of the substances, it is preferable to use fluorenones, quinones, and a benzene derivative having an electronic attraction substituent group, such as Cl, CN, and $NO_2$. Thereby, photosensitivity of the photoreception layer is improved, the residual potential is reduced, and deterioration of photosensitivity after the repeated use is prevented. Thus, it is possible to desirably prevent non-uniformity of concentration of a toner image that is formed using the image forming apparatus including the photoreceptor containing the electron accepting substance in the undercoat layer 14.

Additionally, instead of the above-mentioned coating agent for the undercoat layer, it is preferable to use a dispersion-type coating agent for the undercoat layer. Resistance of the undercoat layer 14 is appropriately controlled using the above-mentioned coating agent to prevent residual charge from being accumulated and to make the undercoat layer 14 thick. Thus, desirable leak resistance of the photoreceptor may be assured. Particularly, the leak may be prevented during the contact charging.

Examples of the dispersion-type coating agent for the undercoat layer include an agent where metal powder, such as aluminum, copper, nickel, and silver, conductive metal oxides, such as antimony oxides, indium oxides, tin oxides, and zinc oxides, and a conductive substance, such as carbon fiber, carbon black, and graphite powder are dispersed in a binder resin. Preferably, metal oxide particles having a first average particle size of 0.5 μm or less are used as the conductive metal oxides. If the first average particle size is excessively large, a local conductive path may be easily formed, causing the leakage of current. As a result, fogging may occur or a high current may leak from the charging device. It is required that resistance of the undercoat layer 14 is appropriately controlled to improve leak resistance. Accordingly, it is preferable that the above-mentioned metal oxide particles have powder resistance of $10^2$ to $10^{11}$ Ω·cm.

Furthermore, if the resistance of the metal oxide particle is lower than the lower limit of the above-mentioned range, the leak resistance is insufficiently obtained. If the resistance is higher than the upper limit of the above-mentioned range, the residual potential is increased. Accordingly, it is more preferable to use the metal oxide particles having the resistance that is in the above-mentioned range, such as tin oxides, titanium oxides, and zinc oxides. Further, two or more types of metal oxide particles may be used while being mixed with each other. The metal oxide particles may be subjected to surface treatment using the coupling agent to control the powder resistance. In connection with this, the coupling agent may be formed of the same material as the coating agent for forming the undercoat layer. Additionally, two or more types of coupling agents may be used while being mixed with each other.

Any known process may be used to perform the surface treatment of the metal oxide particles, and examples of the process include a dry process and a wet process.

In the case of when the dry process is used, first, the metal oxide particles are heated and dried to remove the water adsorbed on the surface. The water adsorbed on the surface is removed to uniformly adsorb the coupling agent on the surface of the metal oxide particle. Next, while the metal oxide particles are agitated using a mixer having high shear force, the coupling agent is directly dropped thereon or the coupling agent that is dissolved in an organic solvent or water is dropped thereon. The resulting particles are sprayed in conjunction with dried air or nitrogen gas to perform uniform treatment. It is preferable that the coupling agent be dropped or sprayed at 50° C. or more. After the coupling agent is added or sprayed, it is preferable to perform calcination at 100° C. or more. The coupling agent may be cured by the calcination to strongly and chemically react with the metal oxide particles. The calcination may be performed at the temperature and the time that are capable of assuring desired electrophotographic properties.

In the case of when the wet process is used, first, the water that is adsorbed on the surface of the metal oxide particles is removed as the dry process. To remove the water that is adsorbed on the surface, a process of removing the water while the particles are agitated and heated in the solvent used to perform the surface treatment and a process of azeotropically removing the water along with the solvent may be performed without the same heating condition as the dry process. Next, the metal oxide particles are dispersed in the solvent using agitation, an ultrasonic wave, a sand mill, an attritor, or a ball mill, the coupling solution is added, agitation or dispersion is performed, and the solvent is removed to perform uniform treatment. After the solvent is removed, it is preferable that the calcination be performed at 100° C. or more. The calcination may be performed at the temperature and the time that are capable of assuring desired electrophotographic properties.

The amount of surface treating agent with respect to the metal oxide particles is necessarily set so as to assure desired electrophotographic properties. The electrophotographic properties are affected by the amount of the surface treating agent attached to the surface of the metal oxide particle after the surface treatment is performed. The amount of the attached silane coupling agent is obtained using intensity of Si that is measured by fluorescent X-ray analysis (caused by the silane coupling agent) and intensity of the main metal element of the used metal oxides. Preferably, the intensity of Si that is measured by the fluorescent X-ray analysis is $1.0\times10^{-5}$ to $1.0\times10^{-3}$ times as high as the intensity of the main metal element. If the intensity is lower than the above-mentioned range, image defect, such as fogging, may easily occur. If the intensity is higher than the above-mentioned range, a concentration may be readily reduced due to an increase in residual potential.

Examples of the binder resin that is contained in the dispersion-type coating agent for the undercoat layer include an acetal resin, such as polyvinyl butyral, a known polymer resin compound, such as a polyvinyl alcohol resin, casein, a polyamide resin, a cellulose resin, gelatin, a polyurethane resin, a polyester resin, a methacryl resin, an acryl resin, a polyvinyl chloride resin, a polyvinyl acetate resin, a vinyl chloride-vinyl acetate-maleic anhydride resin, a silicon resin, a silicon-alkyd resin, a phenol resin, a phenol-formaldehyde resin, a melamine resin, and a urethane resin, and a conductive resin, such as a charge transport resin having a charge transport group or polyaniline.

Of the resins, it is preferable to apply an insoluble resin to the coating solvent of the layer formed on the undercoat layer. Particularly, it is preferable to use the phenol resin, the phenol-formaldehyde resin, the melamine resin, the urethane resin, and the epoxy resin. A ratio of the metal oxide particles to the binder resin of the dispersion-type coating solution for forming the undercoat layer may be set in the range that is capable of assuring desired photoreceptor properties.

Examples of a process of dispersing the metal oxide particles that are subjected to surface treatment through the above-mentioned procedure in the binder resin include a process using a media dispersion device, such as a ball mill, a vibration ball mill, an attritor, a sand mill, and a width-type sand mill, or a medialess dispersion device, such as an agitator, a ultrasonic dispersion device, a roll mill, and a high pressure homogenizer. Additionally, the high pressure homogenizer may be a collision type where the dispersion solution is dispersed using liquid-liquid collision or liquid-wall collision at high pressure, or a passage type where the solution passes through the fine flow path at high pressure to perform dispersion.

The process of forming the undercoat layer using the dispersion-type coating agent for the undercoat layer may be the same as the above-mentioned process of forming the undercoat layer 14 using the coating agent for the undercoat layer.

—Organic Photoreception Layer—

An organic polymer compound for forming the organic photoreception layer 17 may be thermoplastic or thermosetting, and formed by reacting two or more types of molecules with each other.

As described above, the organic photoreception layer 17 may be a function separation type including the charge generation layer 16 and the charge transport layer 18 shown in FIG. 1, or a function integration type. In the case of the function separation type, the charge generation layer or the charge transport layer may be formed on the surface of the electrophotographic photoreceptor.

Furthermore, in the invention, in the case of when the organic photoreception layer 17 is the function integration type, it is necessarily required that the organic photoreception layer 17 contains at least polycarbonates as the binder resin. In the invention, in the case of when the organic photoreception layer 17 is the function separation type (the organic photoreception layer includes the charge generation layer 16 and the charge transport layer 18), the layer that is closer to the surface as compared to the organic photoreception layer 17 necessarily contains at least polycarbonates as the binder resin.

In the case of when the organic photoreception layer 17 is the function integration type, the content of polycarbonates is necessarily 10 to 90 wt %, and preferably 40 to 80 wt % based on whole solids of the material constituting the organic photoreception layer 17.

If the content of polycarbonate is less than 10 wt % based on whole solids of the material constituting the organic photoreception layer 17, there is a problem in that insufficient wear resistance is obtained. If the content is 90 wt % or more, there is a problem in that insufficient charge generation and charge transport properties are obtained.

Additionally, in the case of when the organic photoreception layer 17 is the function separation type and includes a plurality of layers, the content of polycarbonate based on whole solids of the material constituting the outermost surface layer of the plurality of layers is necessarily 10 to 90 wt %, and preferably 40 to 80 wt %.

If the content of polycarbonate is less than 10 wt % based on whole solids of the material constituting the outermost surface layer, there is problem in that insufficient wear resistance is obtained. If the content is 90 wt % or more, there is a problem in that insufficient charge generation or charge transport properties are obtained.

Next, with respect to the organic photoreception layer 17, the charge transport layer 18 and the charge generation layer 16 will be sequentially described.

Examples of the charge transport material used in the charge transport layer 18 include hole transport substances that include an oxadiazole derivative, such as 2,5-bis(p-diethylaminophenyl)-1,3,4-oxadiazole, a pyrazoline derivative, such as 1,3,5-triphenyl-pyrazoline and 1-[pyridyl-(2)]-3-(p-diethylaminostyryl)-5-(p-diethylaminostyryl) pyrazoline, an aromatic tertiary amino compound, such as triphenylamine, tri(p-methyl)phenylamine, N,N-bis(3,4-dimethylphenyl)biphenyl-4-amine, dibenzylaniline, and 9,9-dimethyl-N,N-di(p-tolyl)fluorenone-2-amine, an aromatic tertiary diamino compound, such as N,N'-diphenyl-N,N'-bis(3-methylphenyl)-[1,1-biphenyl]-4,4'-diamine, a 1,2,4-triazine derivative, such as 3-(4'-dimethylaminophenyl)-5,6-di-(4'-methoxyphenyl)-1,2,4-triazine, a hydrazone derivative, such as 4-diethylaminobenzaldehyde-1,1-diphenylhydrazone, 4-diphenylaminobenzaldehyde-1,1-diphenylhydrazone, [p-(diethylamino)phenyl](1-naphthyl)phenylhydrazone, 1-pyrenediphenylhydrazone, 9-methyl-3-carbazolediphenylhydrazone, 1,1-di-(4,4'-methoxyphenyl) acrylaldehydediphenylhydrazone, and β,β-bis(methoxyphenyl)vinyldiphenylhydrazone, a quinazoline derivative, such as 2-phenyl-4-styryl-quinazoline, a benzofuran derivative, such as 6-hydroxy-2,3-di(p-methoxyphenyl)-benzofuran, α-stilbene derivative, such as p-(2,2-diphenylvinyl)-N,N-diphenylaniline, an enamine derivative, a carbazole derivative, such as N-ethyl carbazole, 9-ethyl-3-[(2-methyl-1-indolinylimino)methyl]carbazole, 4-(2-methyl-1-indolinyliminomethyl)triphenylamine, poly-N-vinylcarbazole, and a derivative thereof. Alternatively, polymers that have the groups including the above-mentioned compounds as a main chain or a side chain may be used. The charge transport materials may be used alone, or two or more types of materials may be used while being mixed with each other.

Any binder resin may be applied to the charge transport layer 18, but it is preferable that the binder resin be compatible with the charge transport material and have desirable strength.

Examples of the binder resin include various types of polycarbonate resins containing bisphenol A, bisphenol Z, bisphenol C, or bisphenol TP, or a copolymer thereof, a polyallylate resin or a copolymer thereof, a polyester resin, a methacryl resin, an acryl resin, a polyvinyl chloride resin, a polyvinylidene chloride resin, a polystyrene resin, a polyvinyl acetate resin, a styrene-butadiene copolymer resin, a vinyl chloride-vinyl acetate copolymer resin, a vinyl chloride-vinyl acetate-maleic anhydride copolymer resin, a silicon resin, a silicon-alkyd resin, a phenol-formaldehyde resin, a styrene-acryl copolymer resin, a styrene-alkyd resin, a poly-N-vinylcarbazole resin, a polyvinyl butyral resin, and a polyphenylene ether resin. The resins may be used alone, or two or more types of resins may be used while being mixed with each other.

In the invention, in the case of when the charge transport layer is used as the surface, the binder resin contains the polycarbonate resin in order to efficiently obtain hardening caused by the surface treatment.

The molecular weight of the binder resin that is applied to the charge transport layer 18 depends on the layer forming condition, such as the layer thickness of the organic photoreception layer 17 or the solvent. However, the viscosity average molecular weight of the binder resin is preferably 3,000 to 300,000, and more preferably 20,000 to 200,000.

Additionally, a mixing ratio of the charge transport material and the binder resin is preferably 10:1 to 1:5.

An additive, such as an antioxidant, a photostabilizer, and a thermal stabilizer, may be contained in the charge transport layer 18 and/or the charge generation layer 16 as described later so as to prevent deterioration of the photoreceptor caused by ozone or oxidative gas generated in the image forming apparatus, or light or heat.

Examples of the antioxidant include hindered phenol, hindered amine, paraphenylenediamine, arylalkane, hydroquinone, spirochroman, spiroindanone, or a derivative thereof, an organic sulfur compound, and an organic phosphorus compound.

Specific examples of compounds of the antioxidant are as follows. Examples of the phenol-based antioxidant include 2,6-di-t-butyl-4-methylphenol, styrenated phenol, n-octadecyl-3-(3',5'-di-t-butyl-4'-hydroxyphenyl)-propionate, 2,2'-methylene-bis(4-methyl-6-t-butylphenol), 2-t-butyl-6-(3'-t-butyl-5'-methyl-2'-hydroxybenzyl)-4-methylphenylacrylate, 4,4'-butylidene-bis(3-methyl-6-t-butyl-phenol), 4,4'-thio-bis(3-methyl-6-t-butylphenol), 1,3,5-tris(4-t-butyl-3-hydroxy-2,6-dimethylbenzyl)isocyanurate, tetrakis[methylene-3-(3',5'-di-t-butyl-4'-hydroxy-phenyl)propionate]-methane, 3,9-bis[2-[3-(3-t-butyl-4-hydroxy-5-methylphenyl) propionyloxy]-1,1-dimethylethyl]-2,4,8,10-tetraoxaspiro[5,5]undecane, and 3-3',5'-di-t-butyl-4'-hydroxyphenyl)stearyl propionate.

Examples of the hindered amine-based compound include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, succinic acid-dimethyl-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diimil}{(2,2,6,6-tetramethyl-4-pip eridyl) imino}hexamethylene{(2,3,6,6-tetramethyl-4-piperidyl) imino}], 2-(3,5-di-t-butyl-4-hydroxybenzyl)-2-n-butylmalonic acid bis(1,2,2,6,6-pentamethyl-4-piperidyl), and N,N'-bis(3-aminopropyl)ethylenediamine-2,4-bis[N-butyl-N-(1,2,2,6,6,-pentamethyl-4-piperidyl)amino]-6-chloro-1,3,5-triazine condensate.

Examples of the organic sulfur-based antioxidant include dilauryl-3,3'-thiodipropionate, di-myristyl-3,3'-thiodipropionate, distearyl-3,3'-thiodipropionate, pentaerythritol-tetrakis(β-lauryl-thiopropionate), ditridecyl-3,3'-thiodipropionate, and 2-mercaptobenzimidazole.

Examples of the organic phosphorus-based antioxidant include tris-nonylphenylphosphide, triphenylphosphide, and tris(2,4-di-t-butylphenyl)phosphide.

The organic sulfur-based and the organic phosphorus-based antioxidants are known as a secondary antioxidant, and may be used along with a primary antioxidant, such as phenols or amines, to synergically increase an oxidation prevention ability.

Examples of the photostabilizer include derivatives, such as benzophenones, benzotriazoles, dithiocarbamates, and tetramethylpiperidines.

Examples of the benzophenone-based photostabilizer include 2-hydroxy-4-methoxybenzophenone, 2-hydroxy-4-octoxybenzophenone, and 2,2'-di-hydroxy-4-methoxybenzophenone.

Examples of the benzotriazole-based photostabilizer include 2-(2'-hydroxy-5'-methylphenyl)-benzotriazole, 2-[2'-hydroxy-3'-(3",4",5",6"-tetrahydrophthalimide-methyl)-5'-methylphenyl]-benzotriazole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3',5'-t-butylphenyl)-benzotriazole, 2-(2'-hydroxy-5'-t-octylphenyl)-benzotriazole, and 2-(2'-hydroxy-3',5'-di-t-amylphenyl)-benzotriazole.

Examples of other photostabilizers include 2,4-di-t-butylphenyl-3',5'-di-t-butyl-4'-hydroxybenzoate and nickel dibutyl-dithiocarbamate.

A solution where the above-mentioned charge transport material and the binder resin are dissolved in a suitable solvent may be applied and dried to form the charge transport layer 18. Examples of the solvent that is used to prepare the coating solution for forming the charge transport layer include aromatic hydrocarbons, such as benzene, toluene, and chlorobenzene, ketones, such as acetone and 2-butanone, halogenated aliphatic hydrocarbons, such as methylene chloride, chloroform, and ethylene chloride, cyclic or straight chain-type ethers, such as tetrahydrofuran, dioxane, ethylene glycol, and diethyl ether, or a solvent mixture thereof.

Furthermore, a small amount of silicone oil may be added to the coating solution for forming the charge transport layer as a leveling agent in order to improve smoothness of the coating layer.

The application of the coating solution for forming the charge transport layer may be performed using the process, such as an immersion coating process, a ring coating process, a spray coating process, a bead coating process, a blade coating process, a roller coating process, a knife coating process, and a curtain coating process, according to the shape or the purpose of the photoreceptor.

With respect to the drying, it is preferable to perform the drying by heating after the drying to touch at room temperature. It is preferable to perform the drying by heating at 30 to 200° C. for 5 min to 2 hours.

Additionally, the thickness of the charge transport layer 18 is preferably 5 to 50 μm, and more preferably 10 to 40 μm.

The charge generation material may be deposited using a vacuum deposition process or the solution containing the organic solvent and the binder resin may be applied to form the charge generation layer 16.

Examples of the charge generation material include a selenium compound, such as amorphous selenium, crystalline selenium, a selenium-tellurium alloy, and a selenium-arsenic alloy; an inorganic photoconductor, such as selenium alloys, zinc oxide, and titanium oxide; a colored material thereof; a phthalocyanine compound, such as metal-free phthalocyanine, titanyl phthalocyanine, copper phthalocyanine, tin phthalocyanine, and gallium phthalocyanine; various types of organic pigments, such as squariums, anthanthrones, perylenes, azos, anthraquinones, pyrenes, pyrylium salts, and thiapyrylium salts; and dyes thereof.

Furthermore, the organic pigment typically has various crystalline types. Particularly, it is known that the phthalocyanine compound has various crystalline types, such as α-type and β-type. However, any crystalline type of pigment may be used as long as the pigment has desirable sensitivity and properties.

Of the above-mentioned charge generation materials, it is preferable to use the phthalocyanine compound. In this case, if light is radiated on the photoreception layer, the phthalocyanine compound that is contained in the photoreception layer absorbs a photon to generate a carrier. In connection with this, since the phthalocyanine compound has high quantum efficiency, the photon may be efficiently absorbed to generate the carrier.

Of the phthalocyanine compounds, it is more preferable to use the phthalocyanine compounds described in the following (1) to (3):

(1) The crystalline type of hydroxygallium phthalocyanine that has diffraction peaks at positions of at least 7.6°, 10.0°, 25.2°, and 28.0° of Bragg angles (2θ±0.2°) of X-ray diffraction spectrum using a CuKα-ray as the charge generation material, (2) The crystalline type of chlorogallium phthalocyanine that has diffraction peaks at positions of at least 7.3°, 16.5°, 25.4°, and 28.1° of Bragg angles (2θ±0.2°) of X-ray diffraction spectrum using a CuKα-ray as the charge generation material, and (3) The crystalline type of titanyl phthalocyanine that has diffraction peaks at positions of at least 9.5°, 24.2°, and 27.3° of Bragg angles (2θ±0.2°) of X-ray diffraction spectrum using a CuKα-ray as the charge generation material.

Since the above-mentioned phthalocyanine compounds have high photosensitivity and high stability of the photosensitivity, the photoreceptor that includes the photoreception layer containing the phthalocyanine compound is useful as the photoreceptor of the color image forming apparatus that requires high-speed image formation and desirable repetition reproducibility.

Additionally, peak intensity or position may slightly deviate from the above-mentioned values according to the shape of the crystal or the measurement method. However, if the X-ray diffraction patterns are identical, it may be considered that the crystalline types are the same as each other.

Examples of the binder resin that is applied to the charge generation layer 16 include a polycarbonate resin, such as a bisphenol A type or a bisphenol Z type and a copolymer thereof, a polyallylate resin, a polyester resin, a methacryl resin, an acryl resin, a polyvinyl chloride resin, a polystyrene resin, a polyvinyl acetate resin, a styrene-butadiene copolymer resin, a vinylidene chloride-acryl nitrile copolymer resin, a vinyl chloride-vinyl acetate-maleic anhydride resin, a silicon resin, a silicon-alkyd resin, a phenol-formaldehyde resin, a styrene-alkyd resin, and poly-N-vinylcarbazole.

In the invention, in the case of when the charge generation layer is used as the surface, the binder resin contains the polycarbonate resin in order to efficiently obtain hardening caused by the surface treatment.

The binder resin may be used alone, or two or more types of binder resins may be used while being mixed with each other. It is preferable that a mass ratio of the charge generation material and the binder resin (charge generation material: binder resin) be 10:1 to 1:10. The thickness of the charge generation layer 16 is preferably 0.01 to 5 μm, and more preferably 0.05 to 2.0 μm.

Furthermore, the charge generation layer 16 may contain at least one type of electron accepting substance so as to improve sensitivity, to reduce the residual potential, and to reduce fatigue after the repeated use. Examples of the electron accepting substance that is applied to the charge generation layer include a succinic anhydride, a maleic anhydride, a dibrom maleic anhydride, a phthalic anhydride, a tetrabromophthalic anhydride, tetracyanoethylene, tetracyanoquinodimethane, o-dinitrobenzene, m-dinitrobenzene, chloranyl, dinitroanthraquinone, trinitrofluorenone, a picric acid, an o-nitrobenzoic acid, a p-nitrobenzoic acid, and a phthalic acid. Of the substances, it is preferable to use fluorenones, quinones, and a benzene derivative having an electronic attraction substituent group, such as fluorenones, quinones, Cl, CN, and $NO_2$.

Examples of a process of dispersing the charge generation material in the resin include processes using a roll mill, a ball mill, a vibration ball mill, an attritor, a dynomill, a sand mill, and a colloid mill.

Furthermore, examples of the solvent of the coating solution for forming the charge generation layer 16 include a known organic solvent, for example, an aromatic hydrocarbon-based solvent, such as toluene and chlorobenzene, an aliphatic alcohol-based solvent, such as methanol, ethanol, n-propanol, iso-propanol, and n-butanol, a ketone-based solvent, such as acetone, cyclohexanone, and 2-butanone, a halogenated aliphatic hydrocarbon solvent, such as methylene chloride, chloroform, and ethylene chloride, a cyclic- or straight chain-type ether-based solvent, such as tetrahydrofuran, dioxane, ethylene glycol, and diethyl ether, and an ester-based solvent, such as methyl acetate, ethyl acetate, and n-butyl acetate.

The solvents may be used alone, or two or more types of solvents may be used while being mixed with each other. Any solvent may be used as the solvent used in the case of when two or more types of solvents are mixed with each other as long as the solvent is capable of dissolving the binder resin in the solvent mixture form. However, in the case of when the photoreception layer includes the charge transport layer 18 and the charge generation layer 16 that are sequentially formed on the conductive base, when the charge generation layer 16 is formed using the coating process, such as the immersion coating process where a low layer is easily dissolved, it is preferable to use the solvent that does not dissolve the low layer, such as the charge transport layer. Furthermore, in the case of when the charge generation layer 16 is formed using the spray coating process or the ring coating process where erosion of the low layer is relatively difficult to occur, the selection range of the solvent may be extended.

—Surface Coating Layer—

Next, a description will be given of the surface coating layer 20 formed on the organic photoreception layer 17 that is subjected to surface treatment. In the case of when the surface coating layer 20 is further formed on the organic photoreception layer 17 which is hardened using plasma treatment at the outermost surface thereof, that is, the reformed layer 18A, it is preferable that hardness of the surface coating layer 20 be higher than that of the reformed layer 18A of the organic photoreception layer 17 surface-treated using plasma of gas containing hydrogen or hydrogen and nitrogen in order to improve wear resistance. As described above, the hardness is increased stepwise moving from the organic photoreception layer 17, the reformed layer 18A, and the surface coating layer 20 to avoid problems, such as stripping and cracks, caused by a difference in hardness of the organic photoreception layer and the surface coating layer.

Additionally, volume resistance of the surface coating layer 20 is preferably $10^8$ Ω·cm or more, and more preferably $10^{10}$ Ω·cm or more.

If the volume resistance is less than $10^8$ Ω·cm, the charge flows in the surface coating layer, causing an image flow. Thus, there is a problem in that it is impossible to perform high resolution image printing.

The volume resistances of the reformed layer 18A and the surface coating layer 20 may be measured using a circular electrode (trade name: HR probe of Hiresta IP, manufactured by Mitsubishi Petrochemical Co., Ltd.) according to JIS K 6991. The measurement of the volume resistance will be described referring to the drawings.

Figure 5A:
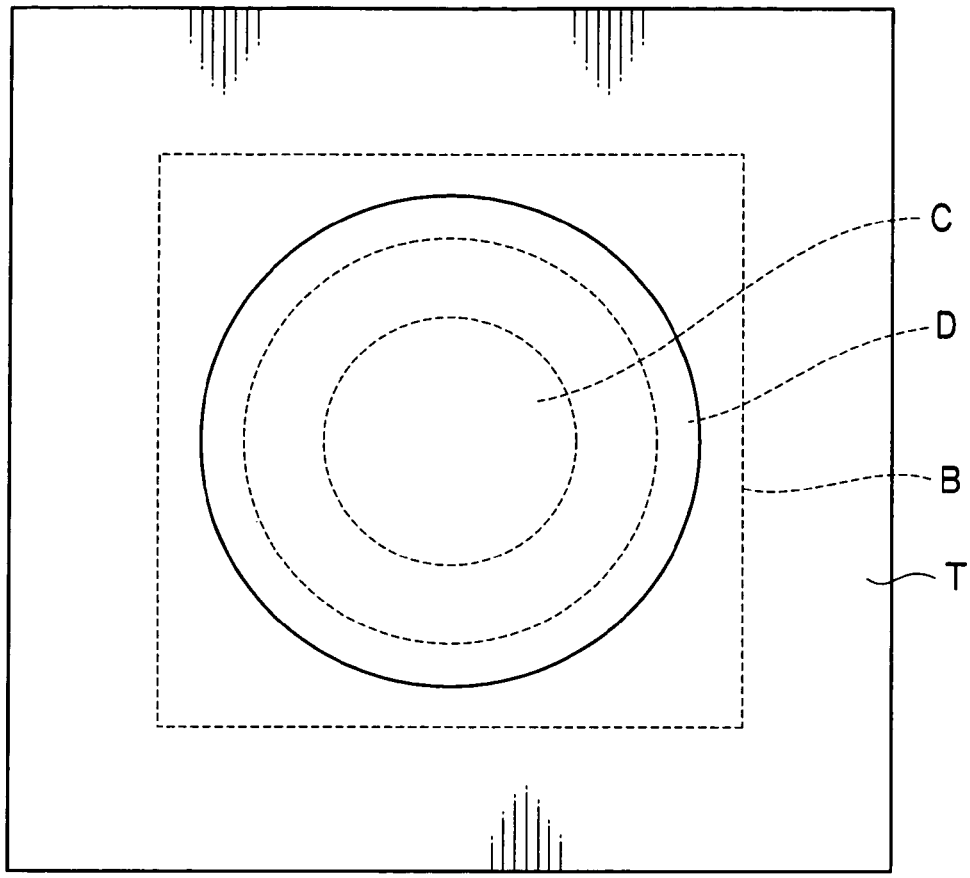
Figure 5B:
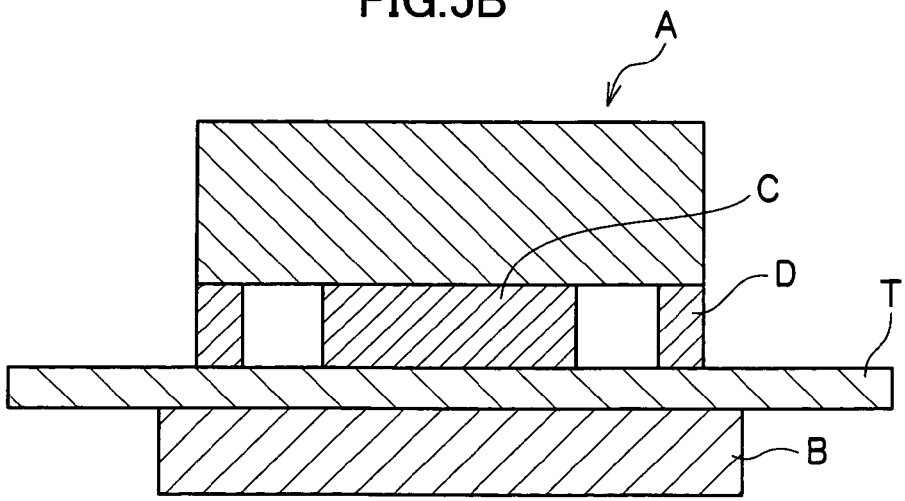

FIGS. 5A and 5B schematically illustrate measurement of volume resistance, in which FIG. 5A is a schematic plan view of the circular electrode and FIG. 5B is a schematic cross-sectional view of the circular electrode of FIG. 5A.

The circular electrode shown in FIGS. 5A and 5B is provided with a first voltage application electrode A and a plate-type insulator B. The first voltage application electrode A is provided with a cylindrical electrode unit C and a ring-shaped electrode unit D that has an inner diameter larger than an outer diameter of the cylindrical electrode unit C and surrounds the cylindrical electrode unit C while the ring-shaped electrode unit D is spaced apart from the cylindrical electrode unit C.

A current I (A) is measured 30 sec after voltage V (V) is applied between the cylindrical electrode unit C of the first voltage application electrode A and the ring-shaped electrode unit D while an organic photoreception layer T that is a measurement target is sandwiched between the cylindrical electrode unit C of the first voltage application electrode A and the ring-shaped electrode unit D, and the plate-type insulator B, thereby measuring the volume resistance.

In connection with this, the volume resistance ρv (Ω·cm) of the photoreceptor may be calculated using the following Equation 3. In the following Equation 3, t denotes the thickness of the photoreceptor T that is the measurement target.

$$\rho v = 19.6 \times (V/I) \times t \qquad \text{Equation 3}$$

Specific examples of the material constituting the surface coating layer 20 include diamond-like carbons, silicon nitrides, silicon carbides, carbon nitrides, gallium nitrides, aluminum nitrides, aluminum oxides, gallium oxides, and zinc oxides.

More preferably, the surface coating layer 20 has high water repellency, and excellent lubrication property when the surface coating layer is applied to the electrophotographic photoreceptor. To assure the above-mentioned properties, it is preferable to use the surface coating layer that is produced by forming a gallium nitride or aluminum nitride thin film and oxidizing the surface of the thin film using natural oxidation because it is possible to maintain water repellency or slidability for a long time when the surface coating layer is applied to the electrophotographic photoreceptor. Additionally, the type of the surface coating layer may be a fine crystal type, a polycrystal type, or an amorphous type.

An impurity may be added to the surface coating layer to control electric properties. For example, the element that is selected from Si, Ge, or Sn may be added as a donor, and the element that is selected from Be, Mg, Ca, Zn, or Sr may be added as an acceptor. Additionally, hydrogen may be contained in the surface coating layer. Hydrogen may terminate defect of bonding to electrically deactivate a defect level.

The surface coating layer 20 may be formed using a known thin film forming process. Examples of the process include, but are not limited to a chemical vapor deposition process (CVD), a sputtering process, an ion plating process, a molecular beam epitaxy process, and a vacuum deposition process.

In the case of when the thin film including gallium nitride or aluminum nitride is formed as the surface coating layer 20, it is preferable to use the plasma organometallic chemical deposition process. The group 13 nitride thin film may be formed using the organometallic chemical deposition process, a hydride epitaxy process, and the molecular beam epitaxy process. However, in the organometallic chemical deposition process, the hydride epitaxy process, and the gas source molecular beam epitaxy process using ammonia gas, the high temperature of 300° C. or more is required to perform decomposition and reaction. Preferably, in the invention, the layer forming temperature is set to 150° C. or less so as to avoid thermal degeneration of the electrophotographic photoreceptor. Furthermore, it is preferable to form the layer acting as the surface coating layer 20 by means of a unit using activated nitrogen that is generated by plasma of nitrogen or ammonia using the plasma organometallic chemical deposition process or the plasma molecular beam epitaxy process where the film is capable of being formed at low temperatures.

The plasma CVD is advantageous in that it is possible to form the layer having the large area and cost is low in comparison with the molecular beam epitaxy process.

(Process Cartridge and Image Forming Apparatus)

Next, a description will be given of the process cartridge and the image forming apparatus using the electrophotographic photoreceptor of the invention.

The electrophotographic photoreceptor 10 or the electrophotographic photoreceptor 11 of the invention is mounted on the image forming apparatus of the invention.

Figure 6:
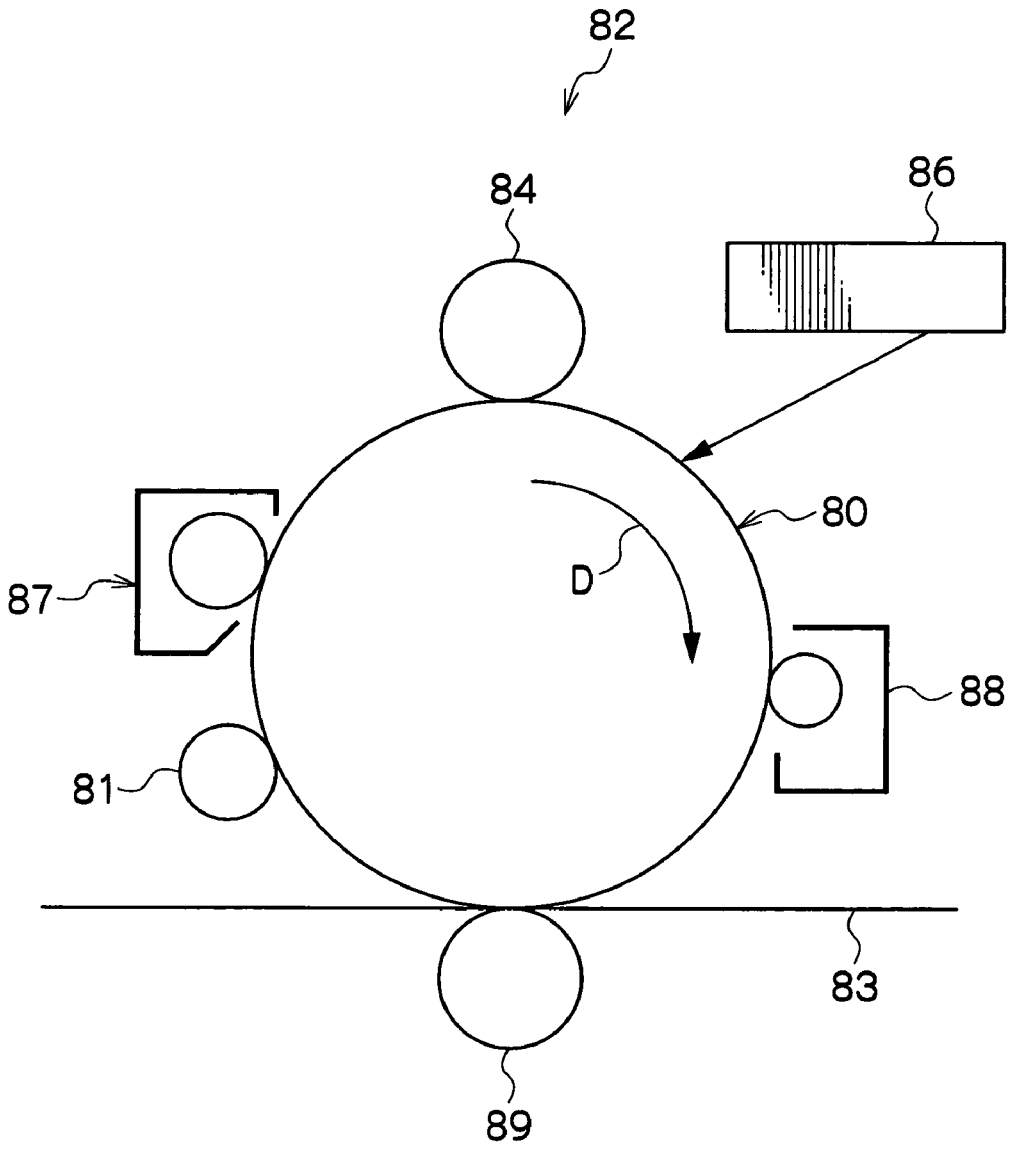
FIG. 6 schematically illustrates a process cartridge and an image forming apparatus according to the invention.

As shown in FIG. 6, the image forming apparatus 82 of the invention is provided with an electrophotographic photoreceptor 80 that rotates in a predetermined direction (the direction D of the arrow in FIG. 6).

A charging unit 84, an exposing unit 86, a developing unit 88, a transferring unit 89, an erasing unit 81, and a cleaning member 87 are formed along the rotation direction of the electrophotographic photoreceptor 80 in the vicinity of the electrophotographic photoreceptor 80.

The charging unit 84 electrically charges the surface of the electrophotographic photoreceptor 80 so that the surface has a predetermined potential. The exposing unit 86 exposes the surface of the electrophotographic photoreceptor 80 that is electrically charged by the charging unit 84 to form an electrostatic latent image according to image data. The developing unit 88 stores a developer containing the toner for developing the electrostatic latent image, and supplies the stored developer to the surface of the electrophotographic photoreceptor 80 to develop the electrostatic latent image, thereby forming a toner image.

The transferring unit 89 transfers the toner image formed on the electrophotographic photoreceptor 80 while a recording medium 83 is sandwiched between the electrophotographic photoreceptor 80 and the transferring device, thereby transferring the image onto the recording medium 83. The toner image that is transferred on the recording medium 83 is fixed to the surface of the recording medium 83 using a fixing unit now shown.

The erasing unit 81 removes electricity from the substance that is attached to the surface of the electrophotographic photoreceptor 80 and electrically charged. The cleaning member 87 is provided to come into contact with the surface of the electrophotographic photoreceptor 80, and removes the substance attached to the surface using friction force to the surface of the electrophotographic photoreceptor 80.

Additionally, the image forming apparatus 82 of the invention may be a tandem device that is provided with a plurality of electrophotographic photoreceptors 80 corresponding to the toners of the various colors. Further, transferring of the toner image onto the recording medium 83 may be performed using an internal transferring process where the toner image formed on the surface of the electrophotographic photoreceptor 80 is transferred onto an internal transfer body and then onto the recording medium.

The process cartridge of the invention is removably provided with respect to the main body of the image forming apparatus 82, and is united with at least one selected from the group consisting of the charging unit 84, the developing unit 88, the cleaning member 87, and the erasing unit 81.

In the process cartridge of the invention, or in the image forming apparatus 82 of the invention, since the electrophotographic photoreceptor of the invention that has hardness and the layer thickness enough to improve wear resistance after the repeated use in the electrophotographic process is used, it is possible to prevent the formation of scars on the surface of the electrophotographic photoreceptor or abrasion of the surface even if it is used for a long time.

EXAMPLE

A better understanding of the invention may be obtained in light of the following Examples which are set forth to illustrate, but are not to be construed to limit the invention.

Example 1

First, an organic photoreceptor where an undercoat layer, a charge generation layer, and a charge transport layer are sequentially layered on an Al base as a conductive base is produced through the following procedure.

—Formation of Undercoat Layer—

A solution that is obtained by agitating and mixing 20 parts by mass of a zirconium compound (trade name: Organotics ZC540, manufactured by Matsumoto Seiyaku), 2.5 parts by mass of a silane compound (trade name: A1100, manufactured by Nippon Unicar Co., Ltd.), 10 parts by mass of a polyvinyl butyral resin (trade name: Esrec BM-S, manufactured by Sekisui Chemical Industries), and 45 parts by mass of butanol is applied on the surface of the Al base having an outer diameter of 84 mm, and dried by heating at 150° C. for 10 min to form the undercoat layer having a thickness of 1.0 μm.

—Formation of Charge Generation Layer—

Next, a mixture that is obtained by mixing 1 part by mass of chlorogallium phthalocyanine as the charge generation material, 1 part by mass of polyvinyl butyral (trade name: Esrec BM-S, manufactured by Sekisui Chemical Industries), and 100 parts by mass of n-butyl acetate is dispersed along with glass beads using a paint shaker for 1 hour to produce a dispersion solution for forming the charge generation layer.

The dispersion solution is applied on the undercoat layer using the dipping process, and then dried at 100° C. for 10 min to form the charge generation layer having a thickness of 0.15 μm.

—Formation of Charge Transport Layer—

Next, 2 parts by mass of the compound shown in the following Structural Formula (1) and 3 parts by mass of the polymer compound (weight average molecular weight 39,000) shown in the following Structural Formula (2) are dissolved in 20 parts by mass of chlorobenzene to produce a coating solution for forming the charge transport layer.

Structural Formula (1)

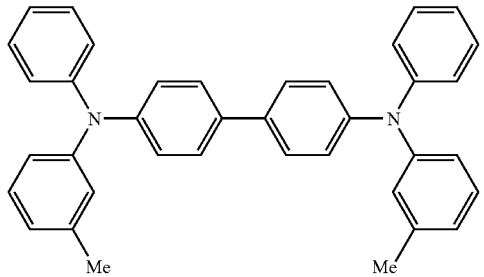

Strucural Formula (2)

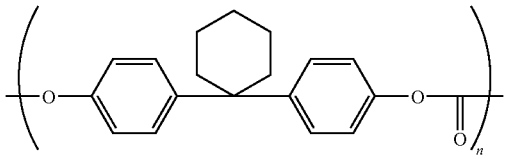

The coating solution is applied on the charge generation layer using the dipping process, and heated at 110° C. for 40 min to form the charge transport layer having the thickness of 20 μm, thereby producing the organic photoreceptor (hereinafter, occasionally referred to as 'untreated photoreceptor') where the undercoat layer, the charge generation layer, and the charge transport layer are sequentially layered on the Al base.

—Plasma Surface Treatment of Organic Photoreceptor—

The surface treatment of the organic photoreceptor is performed using the surface treatment device 30 shown in FIG. 3.

First, the untreated photoreceptor is fixed to a support member 46 in a vacuum chamber 32, and the vacuum chamber 32 is vacuumized through an exhaust pipe 42 using a vacuum exhaust unit 44 so that pressure in the vacuum chamber 32 is $1\times10^{-2}$ Pa. Next, hydrogen gas is fed through an MFC 36 to the untreated photoreceptor in the vacuum chamber 32 at a rate of 3,000 sccm. The pressure in the vacuum chamber is controlled to 100 Pa using a conductance valve. A radio-wave of 13.56 MHz is set to have an output of 600 W using a high frequency electric source 58 and a matching box 56 so as to perform matching using a tuner, and discharge is performed at a discharge electrode 54.

In connection with this, a reflected wave is 0 W.

In the above-mentioned state, exposing to the plasma is performed for 40 min to achieve surface treatment while the untreated photoreceptor rotates at a rate of 5 rpm, thereby producing the electrophotographic photoreceptor where the outermost surface of the organic photoreception layer is reformed. In connection with this, the amount of treatment power with respect to the surface of the untreated photoreceptor is 0.5 W/hr per 1 $cm^2$.

Additionally, during the surface treatment, the untreated photoreceptor is not heated.

Two photoreceptors that are subjected to the surface treatment under the same condition are prepared. One is used in a fracture test at an early state using an XPS and a section SEM while a test for printing one hundred thousand images is not performed. Another is used to observe the section SEM after the test for printing one hundred thousand images is performed.

—Analysis and Evaluation of Reformed Layer Using Plasma Treatment—

The element composition of the surface of the untreated photoreceptor that is not subjected to the surface treatment is measured using the XPS (X-ray photoelectron spectroscopy). The element composition of the surface of the electrophotographic photoreceptor that is subjected to the surface treatment is analyzed using the XPS. As a result, it can be seen that the oxygen element is increased with 5 atom % after the surface treatment as compared to the case of before the surface treatment is performed.

Additionally, the above-mentioned analysis and evaluation are performed after the electrophotographic photoreceptor which is subjected to the surface treatment is separated from the support member 46 so as to be out of the vacuum chamber 32 and then stored in a dark room for about 24 hours.

State of Surface Treatment (Observation of Section)

Figure 11:
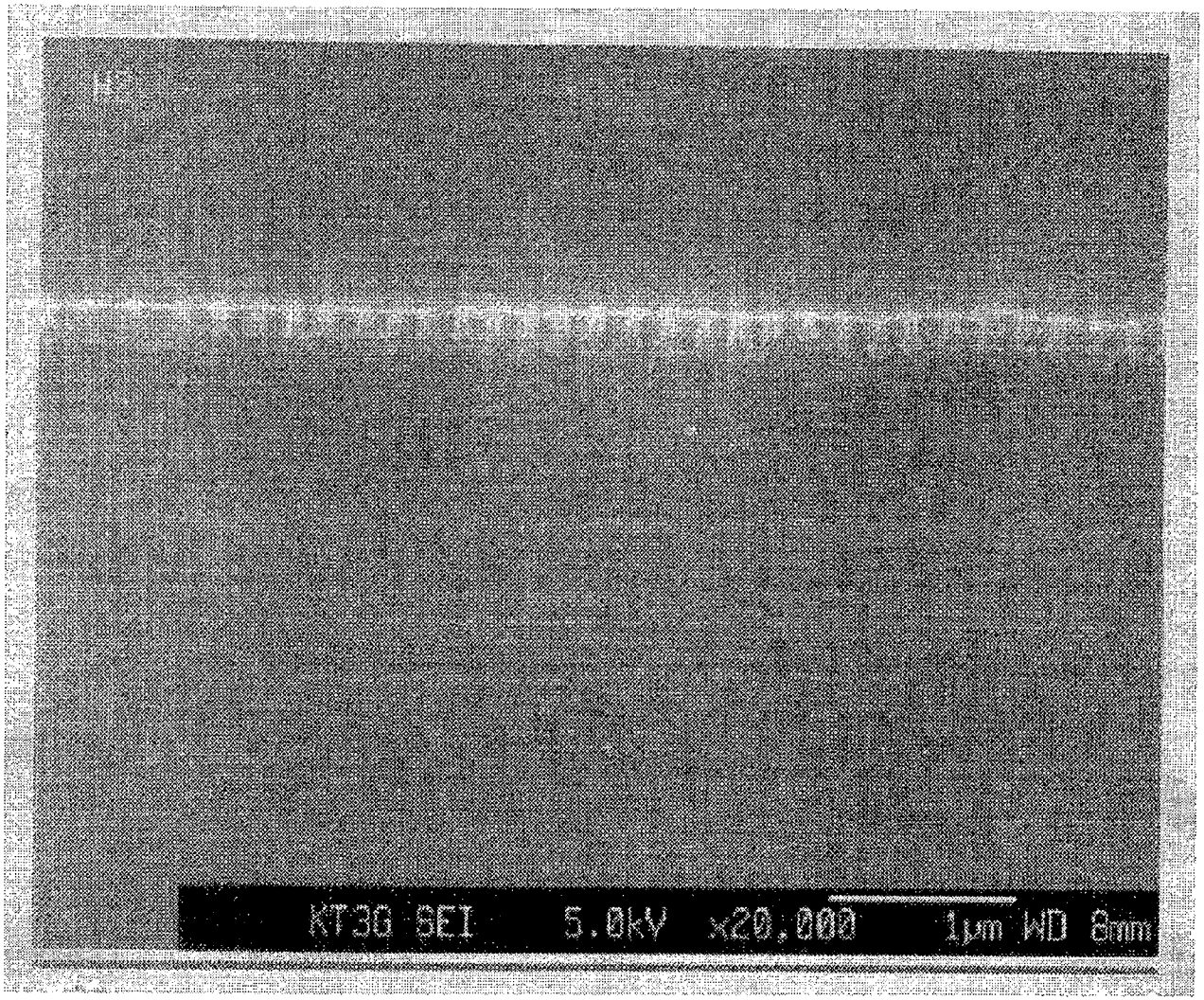
FIG. 11 is a scanning electron microscope picture of a cross-sectional view of a charge transport layer after the surface treatment in example 1.

Next, the photoreceptor is cut in the direction that is perpendicular to the surface thereof after the surface treatment, the surface is covered with the polymer resin, the cutting is performed using a microtome, and the section is observed using a scanning electron microscope (SEM) (trade name: JSM6340F, twenty thousand × magnification, manufactured by JEOL Ltd.). As a result, as shown in the photograph of FIG. 11, it is confirmed that a portion ranging from the surface to the depth of about 0.20 μm (outermost surface, reformed layer) which is considered to be reformed by the plasma is present.

The IR absorption spectrum of the organic photoreception layer which is subjected to the plasma treatment is measured according to the attenuated total reflection method (the ATR method) using IR7000 manufactured by JEOL Ltd. Additionally, the measurement of the organic photoreceptor (untreated photoreceptor) is performed before the treatment.

Figure 7:
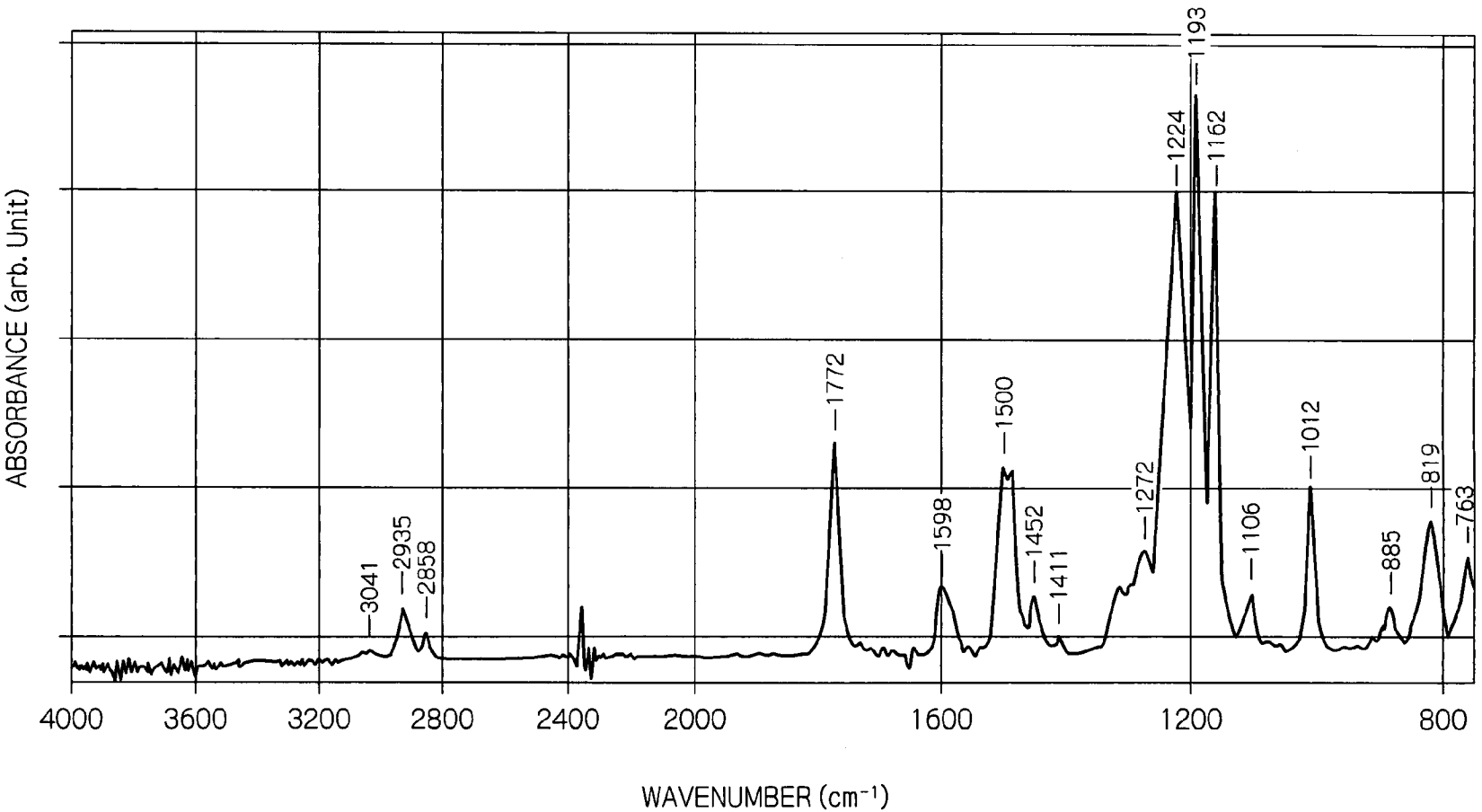
FIG. 7 is a graph showing an IR absorption spectrum of an organic photoreceptor before the surface treatment using plasma in example 1.
Figure 8:
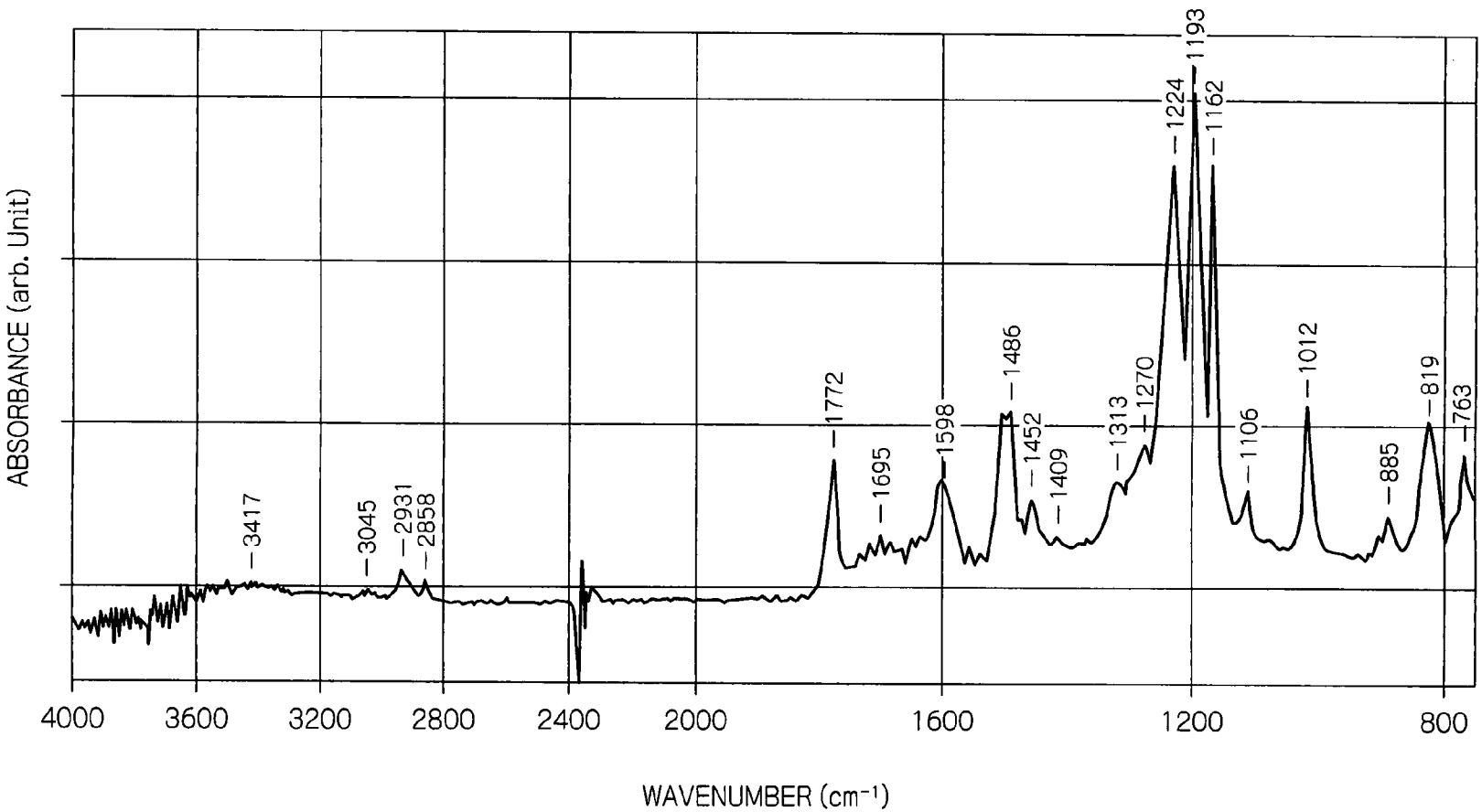
FIG. 8 is a graph showing an IR absorption spectrum of the organic photoreceptor that is subjected to the surface treatment using the plasma in example 1.

FIG. 7 is the IR absorption spectrum of the organic photoreceptor before the surface treatment is performed using the plasma. FIG. 8 is the IR absorption spectrum of the organic photoreceptor that is subjected to surface treatment using the plasma of hydrogen gas. As shown in FIGS. 7 and 8, it can be seen that absorption of the carbonyl functional group from the outermost surface of the untreated photoreceptor at 1772 $cm^{-1}$, that is, absorption intensity of the absorption peak by the carbonate bonding, is reduced after the surface treatment. Further, the absorption peak of the OH group at 3400 $cm^{-1}$, and the absorption peak of the C═O group or the COOH group at 1600 to 1750 $cm^{-1}$ are observed at the surface of the organic photoreception layer after the surface treatment while the peak is not observed at the surface of the untreated photoreceptor. This implies that the OH group, the C═O group, and the COOH group are formed.

Accordingly, it is believed that the crosslinking structure is formed on the outermost surface of the organic photoreception layer by treating the outermost surface of the organic photoreception layer containing polycarbonate using the plasma of hydrogen.

Next, the electrophotographic photoreceptor which is subjected to the surface treatment is mounted on the process cartridge as the photoreceptor for DocuCenter Color 500 manufactured by FUJI XEROX Co., Ltd. to be provided in DocuCenter Color 500. The images that include a low resolution region (1 line/mm, area coverage 50%) and a high resolution region (10 lines/mm, area coverage 50%) are continuously formed on one hundred thousand papers having the A4 size (trade name: P paper, manufactured by FUJI XEROX OFFICE SUPPLY Co., Ltd.) under the high temperature and humidity environment (28° C., 80% RH) to perform the print test. Thereby, sliding, image defect, and contact angle to water are evaluated with respect to an early state and after the one hundred thousand images are formed.

Additionally, the term 'early state' means the state immediately after the images are formed on 10 papers having the A4 size.

Furthermore, the term 'after the images are formed' means the state immediately after the images are formed on one hundred thousand papers having the A4 size.

The above-mentioned properties are measured and evaluated using the following methods.

—Slidability Evaluation—

The magnitude of friction when the surface of the photoreceptor is rubbed using the cleaning blade (trade name: DocuCenter Color 500, manufactured by FUJI XEROX Co., Ltd.) is compared with that of the organic photoreceptor that is not treated, and evaluation is performed on the basis of the following determination criteria.

G1: the case of when the magnitude of friction is identical to or smaller than that of the organic photoreceptor before the organic photoreceptor is used.

G2: the case of when the magnitude of friction is identical to or smaller than that of the organic photoreceptor after one hundred thousand prints are formed, and the case of when the magnitude of friction is larger than that of the organic photoreceptor before the organic photoreceptor is used.

G3: the case of when the magnitude of friction is identical to or larger than that of the organic photoreceptor after one hundred thousand prints are formed.

—Image Evaluation—

The quality of image that is formed on the paper having the A4 size is evaluated on the basis of the following criteria.

G1: the case of when resolution is desirable at the high resolution part and the low resolution part.

G2: the case of when resolution is undesirable at the high resolution part but resolution is desirable at the low resolution part.

G3: the case of when resolution is undesirable at both the high resolution part and the low resolution part.

—Water Contact Angle—

The measurement of the 'water contact angle' is performed using the above-mentioned process of measuring the 'water contact angle'.

—Evaluation of Abrasion Amount—

The thickness of the reformed surface layer is measured by the observation of the section of the photoreceptor using the SEM after one hundred thousand images are formed. The above-mentioned thickness is compared with the thickness of the reformed surface layer that is measured while the print test is not performed to evaluate the abrasion amount.

G1: abrasion amount of 0.00 μm or more and less than 0.05 μm

G2: abrasion amount of 0.05 μm or more and less than 0.10 μm

G3: abrasion amount of 0.10 μm or more

The evaluation results are described in Table 1.

Example 2

The procedure of Example 1 is repeated to produce the electrophotographic photoreceptor, except that the mixed gas of 3,000 sccm of hydrogen gas and 300 sccm of nitrogen is fed into the vacuum chamber 32 during the surface treatment.

—Analysis and Evaluation of Reformed Layer Using Plasma Treatment—

The element composition of the surface of the untreated photoreceptor that is not subjected to the surface treatment is measured using the XPS (X-ray photoelectron spectroscopy). The element composition of the surface of the electrophotographic photoreceptor that is subjected to the surface treatment is analyzed using the XPS. As a result, it can be seen that the oxygen element is increased with 6 atom % after the surface treatment as compared to the case of before the surface treatment is performed.

State of the Surface Treatment (Observation of the Section)

The SEM observation of the section is performed through the same procedure as Example 1. The photoreceptor is cut in the direction that is perpendicular to the surface thereof after the surface treatment, the surface is covered with the polymer resin, the cutting is performed using a microtome, and the section is observed using a scanning electron microscope (SEM) (trade name: JSM6340F, twenty thousand × magnification, manufactured by JEOL Ltd.). As a result, it is confirmed that a portion ranging from the surface to the depth of about 0.20 μm (outermost surface, reformed layer) which is considered to be reformed by the plasma is present.

Additionally, the IR absorption spectrum of the organic photoreception layer which is subjected to the plasma treatment is measured according to the attenuated total reflection method (the ATR method) using IR7000 manufactured by JEOL Ltd. Furthermore, the measurement of the organic photoreceptor (untreated photoreceptor) is performed before the treatment.

Figure 9:
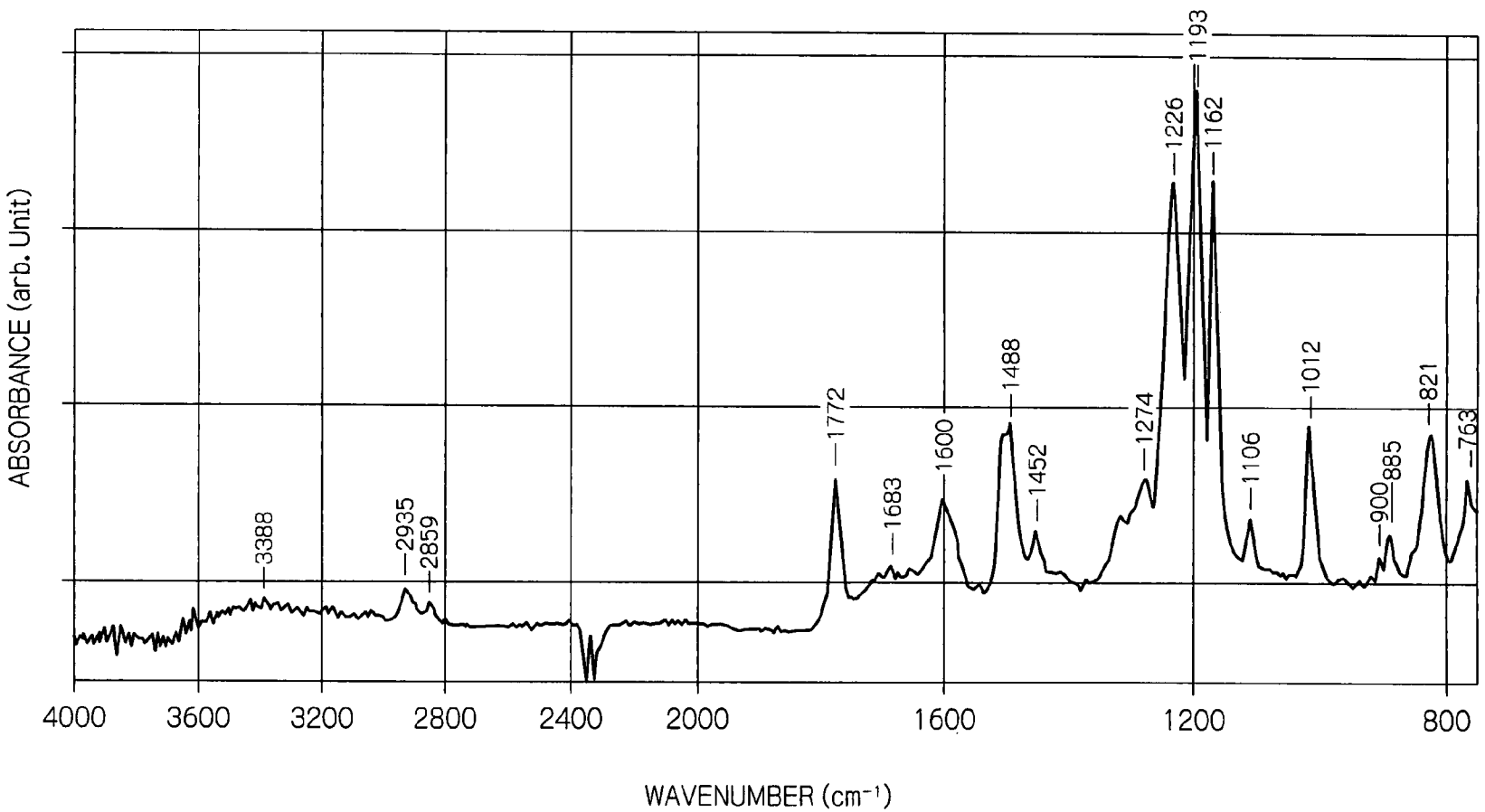
FIG. 9 is a graph showing an IR absorption spectrum of an organic photoreceptor that is subjected to surface treatment using plasma in example 2.

FIG. 9 is the IR absorption spectrum of the organic photoreceptor after the surface treatment is performed using the plasma. Like FIG. 8, a change of the untreated photoreceptor is obtained due to the plasma treatment. Accordingly, it is believed that the crosslinking structure is formed on the outermost surface of the organic photoreception layer by treating the outermost surface of the organic photoreception layer containing polycarbonate using the plasma of hydrogen.

The electrophotographic photoreceptor is evaluated using the same method as Example 1. The results are described in Table 1.

Example 3

The untreated photoreceptor which is obtained in Example 1 is fixed to a support member 46 in a vacuum chamber 32 of a surface treatment device 30 of FIG. 3, and the vacuum chamber 32 is vacuumized through an exhaust pipe 42 using a vacuum exhaust unit 44 so that pressure in the vacuum chamber 32 is $1\times10^{-2}$ Pa. Next, 3,000 sccm of hydrogen gas and 300 sccm of nitrogen gas are fed from a gas feeding pipe 34 through an MFC 36 to the untreated photoreceptor in the vacuum chamber 32. Furthermore, the pressure in the vacuum chamber is controlled to 100 Pa using a conductance valve. A radio-wave of 13.56 MHz is set to have an output of 600 W using a high frequency electric source 58 and a matching box 56 so as to perform matching using a tuner, and discharge is performed at a discharge electrode 54.

In connection with this, a reflected wave is 0 W.

In the above-mentioned state, exposing to the plasma is performed for 40 min while the untreated photoreceptor rotates at a rate of 5 rpm, thereby producing the electrophotographic photoreceptor where the outermost surface of the organic photoreception layer is reformed. In connection with this, the amount of treatment power with respect to the surface of the untreated photoreceptor is 0.5 W/hr per 1 $cm^2$.

Additionally, during the surface treatment, the untreated photoreceptor is not heated.

Furthermore, while the electrophotographic photoreceptor where the outermost surface of the organic photoreception layer is reformed rotates at a rate of 5 rpm, 3,000 sccm of hydrogen gas, 300 sccm of nitrogen gas, and 5 sccm of trimethyl gallium that is diluted by hydrogen are fed from the gas feeding pipe 34 through the MFC 36 to the electrophotographic photoreceptor where the outermost surface of the organic photoreception layer is reformed in the vacuum chamber 32. Furthermore, the pressure in the vacuum chamber is controlled to 100 Pa using the conductance valve. The radio-wave of 13.56 MHz is set to have the output of 600 W using the high frequency electric source 58 and the matching box 56 so as to perform matching using the tuner, and discharge is performed at the discharge electrode 54. In connection with this, the reflected wave is 0 W. The above-mentioned procedure is continued for 1 hour to form the surface coating layer on the organic photoreception layer, the outermost surface of which is reformed.

Hydrogen is bubbled into trimethyl gallium at 0° C. as the carrier gas to feed the trimethyl gallium gas that is diluted by hydrogen.

Furthermore, while the surface coating layer is formed, the electrophotographic photoreceptor where the surface coating layer is not formed is not heated.

—Analysis and Evaluation of Surface Coating Layer—

The element composition of the surface coating layer is measured using the XPS (X-ray photoelectron spectroscopy). As a result, the composition ratio of Ga:N:O is 42:8:50 at the surface, and the composition ratio of Ga:N:O is 48:42:10 when etching is performed to the depth of about 50 nm from the surface. Accordingly, it can be seen that the gallium nitride thin film containing oxygen is formed.

State of Surface Treatment (Observation of Section)

Next, the photoreceptor is cut in the direction that is perpendicular to the surface thereof after the surface treatment, the surface is covered with the polymer resin, the cutting is performed using the microtome, and the section is observed using the scanning electron microscope (SEM) (trade name: JSM6340F, twenty thousand × magnification, manufactured by JEOL Ltd.). As a result, it is confirmed that a portion ranging from the surface to the depth of about 0.21 μm which is considered the surface coating layer is present, and that a portion (reformed layer) ranging from the surface coating layer to the depth of about 0.20 μm (the outermost surface of the organic photoreception layer) which is considered to be reformed by the plasma is present.

Additionally, an adhesion tape (trade name: Cellophane tape (registered trademark), manufactured by Nichiban Co., Ltd.) is removed from the surface of the electrophotographic photoreceptor where the surface coating layer is formed to perform a stripping test. However, there is no substance stripped from the surface. Accordingly, it can be seen that adhesion property to the organic photoreception layer of the surface coating layer is excellent.

Additionally, the surface of the electrophotographic photoreceptor is observed after one hundred thousand images are formed using an optical microscope that is provided with an ocular of 5× magnification and an object lens of 10× magnification at 50× magnification in order to check the presence of cracks of the surface. As a result, the cracks are not observed on the surface.

The electrophotographic photoreceptor is evaluated using the same method as Example 1. The results are described in Table 1.

Example 4

The procedure of Example 3 is repeated to produce the electrophotographic photoreceptor, except that trimethyl aluminum is used instead of trimethyl gallium gas and 5 sccm of trimethyl aluminum diluted by hydrogen is fed while the surface coating layer is formed.

Hydrogen is bubbled into trimethyl aluminum at 20° C. as the carrier gas to feed the trimethyl aluminum gas that is diluted by hydrogen.

Furthermore, while the surface coating layer is formed, the electrophotographic photoreceptor where the surface coating layer is not formed is not heated.

—Analysis and Evaluation of Surface Coating Layer—

The element composition of the surface coating layer is measured using the XPS (X-ray photoelectron spectroscopy). As a result, the composition ratio of Al:N:O is 39:10:51 at the surface, and the composition ratio of Al:N:O is 49:41:10 when etching is performed to the depth of about 50 nm from the surface. Accordingly, it can be seen that the aluminum nitride thin film containing oxygen is formed.

State of Surface Treatment (Observation of Section)

Next, the photoreceptor is cut in the direction that is perpendicular to the surface thereof after the surface treatment, the surface is covered with the polymer resin, the cutting is performed using the microtome, and the section is observed using the scanning electron microscope (SEM) (trade name: JSM6340F, twenty thousand × magnification, manufactured by JEOL Ltd.). As a result, it is confirmed that a portion ranging from the surface to the depth of about 0.15 μm which is considered the surface coating layer is present, and that a portion (reformed layer) ranging from the surface coating layer to the depth of about 0.20 μm (the outermost surface of the organic photoreception layer) which is considered to be reformed by the plasma is present.

Additionally, an adhesion tape (trade name: Cellophane tape (registered trademark), manufactured by Nichiban Co., Ltd.) is removed from the surface of the electrophotographic photoreceptor where the surface coating layer is formed to perform a stripping test. However, there is no substance stripped from the surface. Accordingly, it can be seen that adhesion property to the organic photoreception layer of the surface coating layer is excellent.

Additionally, the surface of the electrophotographic photoreceptor is observed after one hundred thousand images are formed using an optical microscope that is provided with an ocular of 5× magnification and an object lens of 10× magnification at 50× magnification in order to check the presence of cracks of the surface. As a result, the cracks are not observed on the surface.

The electrophotographic photoreceptor is evaluated using the same method as Example 1. The results are described in Table 1.

Comparative Example 1

The untreated photoreceptor that is produced in Example 1 is used as the electrophotographic photoreceptor to perform evaluation through the same method as Example 1. The results are described in Table 1.

Comparative Example 2

The untreated photoreceptor that is produced in Example 1 is subjected to the plasma surface treatment using the same method as Example 1 to produce the electrophotographic photoreceptor, except that the nitrogen gas is fed instead of the hydrogen gas to the discharge electrode 54 in the vacuum chamber 32 at a rate of 3,000 sccm.

The electrophotographic photoreceptor that is subjected to the surface treatment is separated from the support member 46 so as to be out of the vacuum chamber 32. The IR absorption spectrum of the organic photoreception layer which is subjected to the plasma treatment is measured according to the attenuated total reflection method (the ATR method) using IR7000 manufactured by JEOL Ltd.

Figure 10:
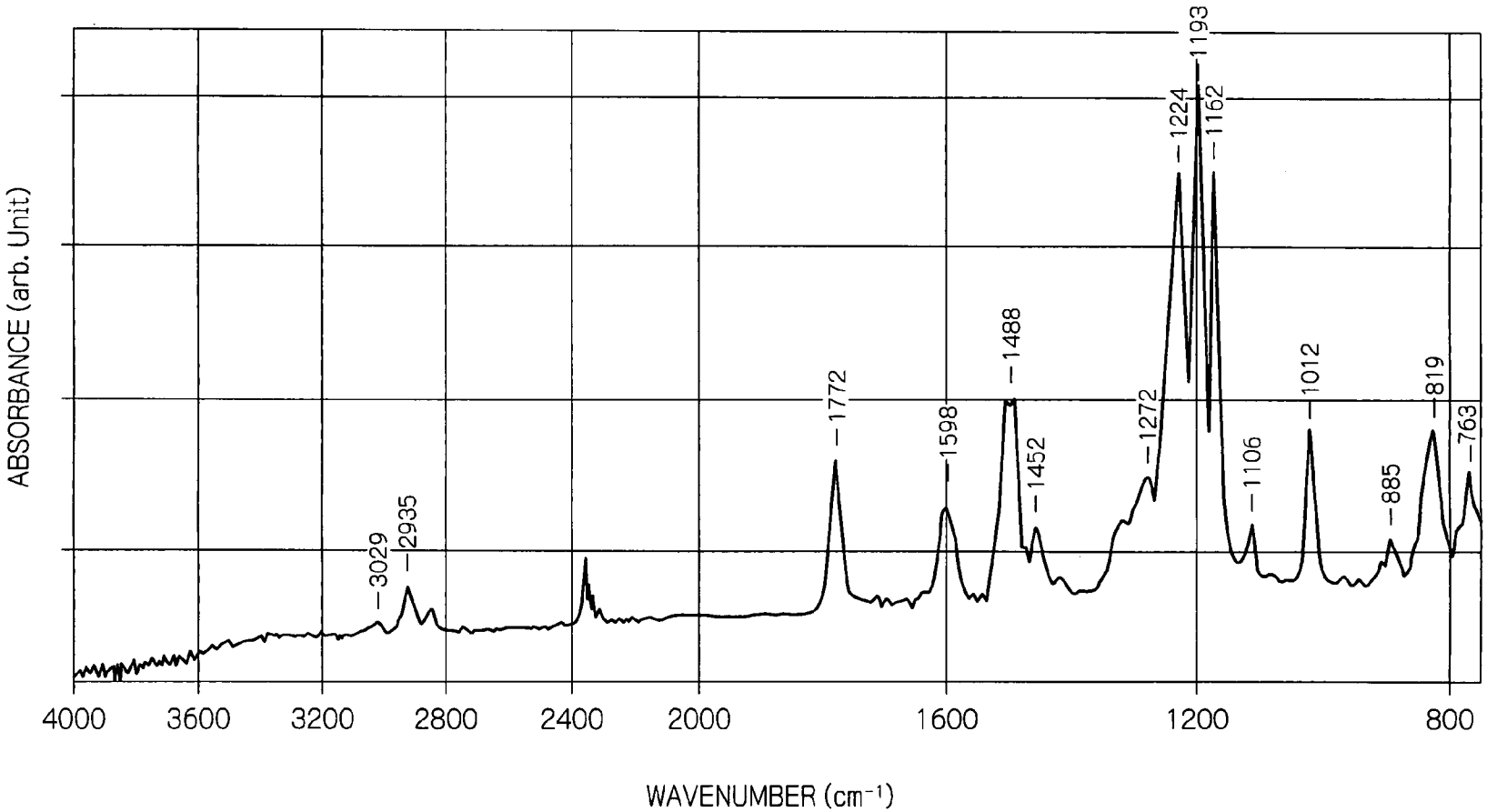
FIG. 10 illustrates an IR absorption spectrum of an organic photoreceptor that is subjected to surface treatment using plasma in comparative example 2.

FIG. 10 is the IR absorption spectrum of the organic photoreceptor that is subjected to the surface treatment using the plasma of nitrogen gas. As shown in FIG. 10, the absorption peak of the OH group at 3400 $cm^{-1}$, and the absorption peak of the C═O group or the COOH group at 1600 to 1750 $cm^{-1}$ are not observed. Hence, the results implying the formation of the OH group, the C═O group, and the COOH group are not obtained.

Accordingly, when the outermost surface of the organic photoreception layer containing polycarbonate is treated using the plasma of only nitrogen, the results implying the formation of the crosslinking structure on the outermost surface of the organic photoreception layer are not obtained.

Comparative Example 3

The untreated photoreceptor which is obtained in Example 1 is fixed to a support member 46 in a vacuum chamber 32 of a surface treatment device 30 of FIG. 3, and the vacuum chamber 32 is vacuumized through an exhaust pipe 42 using a vacuum exhaust unit 44 so that pressure in the vacuum chamber 32 is $1\times10^{-2}$ Pa. Next, 3,000 sccm of nitrogen gas and 5 sccm of trimethyl gallium gas diluted by hydrogen are fed from a gas feeding pipe 34 through an MFC 36 to a discharge electrode 54 in the vacuum chamber 32. Furthermore, the pressure in the vacuum chamber is controlled to 100 Pa using a conductance valve. A radio-wave of 13.56 MHz is set to have an output of 600 W using a high frequency electric source 58 and a matching box 56 so as to perform matching using a tuner, and discharge is performed at the discharge electrode 54.

In connection with this, a reflected wave is 0 W.

In the above-mentioned state, the surface coating layer is formed on the organic photoreceptor for 1 hour while the untreated photoreceptor rotates at a rate of 5 rpm.

Additionally, while the surface coating layer is formed, the electrophotographic photoreceptor where the surface coating layer is not formed is not heated.

—Analysis and Evaluation of Surface Coating Layer—

The element composition of the surface coating layer is measured using the XPS (X-ray photoelectron spectroscopy). As a result, the composition ratio of Ga:N:O is 35:10:55 at the surface, and the composition ratio of Ga:N:O is 41:31:28 when etching is performed to the depth of about 50 nm from the surface. Accordingly, it can be seen that the gallium nitride thin film containing oxygen is formed.

Additionally, an adhesion tape (trade name: Cellophane tape (registered trademark), manufactured by Nichiban Co., Ltd.) is removed from the surface of the electrophotographic photoreceptor where the surface coating layer is formed to perform a stripping test. As a result, the substance that is stripped from the surface is observed.

Additionally, the surface of the electrophotographic photoreceptor is observed after one hundred thousand images are formed using an optical microscope that is provided with an ocular of 5× magnification and an object lens of 10× magnification at 50× magnification in order to check the presence of cracks of the surface. As a result, the cracks are observed on the surface, and their widths are larger than 10 μm.

The electrophotographic photoreceptor is evaluated using the same method as Example 1. The results are shown in Table 1.

TABLE 1

| | | | Early state | | | After image printing | | | |
|---|---|---|---|---|---|---|---|---|---|
| | Plasma treatment | Surface coating layer | Sliding | Image | Water contact angle (°) | Sliding | Image | Water contact angle (°) | Abrasion amount (μm) |
| Example 1 | Hydrogen | None | G1 | G1 | 55 | G1 | G2 | 49 | G2 |
| Example 2 | Mixing of hydrogen and nitrogen | None | G1 | G1 | 52 | G1 | G2 | 47 | G2 |
| Example 3 | Mixing of hydrogen and nitrogen | GaN | G2 | G1 | 75 | G1 | G1 | 88 | G1 |
| Example 4 | Mixing of hydrogen and nitrogen | AlN | G2 | G1 | 62 | G1 | G1 | 89 | G1 |
| Comparative Example 1 | None | None | G1 | G1 | 76 | G2 | G1 | 80 | G3 |
| Comparative Example 2 | Nitrogen | None | G1 | G3 | 46 | G2 | G1 | 80 | G3 |
| Comparative Example 3 | None | GaN | G3 | Not evaluated | Not evaluated | Not evaluated | G1 | Not evaluated | Not evaluated |

The abrasion amount of the electrophotographic photoreceptor that is produced in Comparative Example 1 is 3 μm or more as a result of the SEM observation. Accordingly, the abrasion amount of the electrophotographic photoreceptor that is produced in Example 1 is about one-thirtieth or less of those of the electrophotographic photoreceptor that is produced in Comparative Example 1 and the electrophotographic photoreceptor that is produced in Comparative Example 2.

Additionally, with respect to the evaluation of the image of the electrophotographic photoreceptor that is produced in Example 1, it can be seen that there is no defect on the early image but the high resolution part is not developed on the image after one hundred thousand images are printed.

Furthermore, with respect to the slidability, the early drum properties are the same as the drum properties after one hundred thousand images are printed. Additionally, the surface of the electrophotographic photoreceptor after one hundred thousand images are printed is observed with the naked eye, resulting in the finding that the surface is the mirror-surface.

Additionally, the abrasion amount of the electrophotographic photoreceptor that is produced in Example 2 is about one-thirtieth or less of those of the electrophotographic photoreceptor that is produced in Comparative Example 1 and the electrophotographic photoreceptor that is produced in Comparative Example 2.

Additionally, with respect to the evaluation of the image, it can be seen that there is no defect on the early image but the high resolution part is not developed on the image after one hundred thousand images are printed.

Further, with respect to the slidability, the early drum properties are the same as the drum properties after one hundred thousand images are printed.

Additionally, the abrasion amounts of the electrophotographic photoreceptor that is produced in Example 3 and the electrophotographic photoreceptor that is produced in Example 4 are about one-sixtieth or less of those of the electrophotographic photoreceptor that is produced in Comparative Example 1 and the electrophotographic photoreceptor that is produced in Comparative Example 2.

Additionally, with respect to the evaluation of the images of the electrophotographic photoreceptor that is produced in Example 3 and the electrophotographic photoreceptor that is produced in Example 4, fair results are obtained on the early image and the image after one hundred thousand images are printed. Furthermore, with respect to the slidability, the early drum properties are slightly poorer than those of the electrophotographic photoreceptor produced in Comparative Example 1 that is not subjected to surface treatment. However, with respect to the drum properties after one hundred thousand images are printed, the slidability is improved. Additionally, the surface of the electrophotographic photoreceptor after one hundred thousand images are printed is observed with the naked eye, resulting in the confirmation that the surface is the mirror-surface.

Meanwhile, in the electrophotographic photoreceptors that are produced in Comparative Examples 1 and 2, fair results are obtained with respect to the evaluation of the quality of printed image. However, the abrasion amount is more than those of Examples 1 to 4. Furthermore, in the electrophotographic photoreceptor that is produced in Comparative Example 1, the slidability of the drum after one hundred thousand images are printed is lower than that of the drum at the early state.

The surface of the electrophotographic photoreceptor that is produced in Comparative Example 1 after one hundred thousand images are printed is observed with the naked eye, resulting in the confirmation that the surface is the rough. Surface roughness is measured using surface roughness and contour profile measuring instrument (trade name: SURFCOM 550A, manufactured by TOKYO SEIMITSU CO., LTD.). As a result, the surface roughness (RMS) is 0.2 μm.

Therefore, the electrophotographic photoreceptors that are produced in Comparative Examples 1 and 2 have the fair quality of image. However, the abrasion amount is large and the slidability is reduced due to the continuous image formation as compared to the electrophotographic photoreceptors that are produced in Examples 1 to 4.

Additionally, it is confirmed that the electrophotographic photoreceptor that is produced in Comparative Example 3 has the crack having the width of 10 μm or more as a result of the observation of the surface of the electrophotographic photoreceptor using the optical microscope. The surface of the electrophotographic photoreceptor that is produced in Comparative Example 3 is evaluated in terms of the slidability, resulting in the confirmation that the film is removed to expose the surface of the organic photoreception layer. Accordingly, it is impossible to perform evaluation with respect to the early drum properties, the drum properties after one hundred thousand images are printed, and the abrasion amount.

From the evaluation results, it can be seen that the electrophotographic photoreceptors produced in Examples 1 to 4 have the smaller abrasion amount and the better wear resistance even though the electrophotographic photoreceptors are mounted on the image forming apparatus in comparison with the electrophotographic photoreceptors produced in Comparative Examples 1 to 3.

Furthermore, the electrophotographic photoreceptors according to the invention which are produced in Examples 3 and 4 and in which the surface coating layer is formed have higher water contact angle at the early state and after the images are formed as compared to the electrophotographic photoreceptors according to the invention which are produced in Examples 1 and 2 and in which the surface coating layer is not formed. Therefore, it can be seen that it is possible to provide the electrophotographic photoreceptor having excellent water repellency by forming the surface coating layer. Furthermore, the electrophotographic photoreceptors that are produced in Examples 3 and 4 have the higher water contact angle after the images are formed as compared to the early state. Thus, it is possible to maintain water repellency for a long time.

Furthermore, in the electrophotographic photoreceptors according to the invention which are produced in Examples 3 and 4 and in which the surface coating layer is formed, it is possible to maintain fair slidability for a longer time as compared to the electrophotographic photoreceptors according to the invention which are produced in Examples 1 and 2 and in which the surface coating layer is not formed.

Additionally, in the electrophotographic photoreceptors according to the invention which are produced in Examples 3 and 4 and in which the surface coating layer is formed, the abrasion amount is smaller as compared to the electrophotographic photoreceptors according to the invention which are produced in Examples 1 and 2 and in which the surface coating layer is not formed. Thus, it is possible to still more improve wear resistance.

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic photoreceptor comprising an organic photoreception layer that is formed on a conductive base and includes at least polycarbonate, the outermost surface of the organic photoreception layer having been subjected to surface treatment using plasma of gas containing hydrogen or hydrogen and nitrogen.

2. The electrophotographic photoreceptor of claim 1, wherein the organic photoreception layer includes a plurality of layers, and the outermost surface layer includes polycarbonate.

3. The electrophotographic photoreceptor of claim 1, wherein the outermost surface of the organic photoreception layer that is subjected to the surface treatment is about 0.01 to 3.0 μm in thickness.

4. The electrophotographic photoreceptor of claim 3, wherein the outermost surface of the organic photoreception layer that has been subjected to the surface treatment is about 0.05 to 3.0 μm in thickness.

5. The electrophotographic photoreceptor of claim 1, wherein an oxygen element content of the outermost surface of the organic photoreception layer that has been subjected to the surface treatment is increased by about 0.1 to 20 atom % in comparison with the oxygen element content before the surface treatment.

6. The electrophotographic photoreceptor of claim 1, wherein a surface coating layer is layered on the organic photoreception layer that has been subjected to the surface treatment.

7. The electrophotographic photoreceptor of claim 6, wherein the surface coating layer includes at least nitrogen and a group 13 element from the periodic table.

8. The electrophotographic photoreceptor of claim 7, wherein the surface coating layer is formed of a thin film including any one or both of Ga and Al as the group 13 element.

9. The electrophotographic photoreceptor of claim 6, wherein the surface coating layer is about 0.01 to 3.0 μm in thickness.

10. The electrophotographic photoreceptor of claim 9, wherein the surface coating layer is about 0.01 to 0.5 μm in thickness.

11. The electrophotographic photoreceptor of claim 1, wherein a water contact angle of the surface of the electrophotographic photoreceptor is 40° or more.

12. The electrophotographic photoreceptor of claim 11, wherein a water contact angle of the surface of the electrophotographic photoreceptor is 70° or more.

13. A process cartridge that is removably provided to a main body of an image forming apparatus, the process cartridge comprising:

the electrophotographic photoreceptor of claim 1; and at least one selected from a charging unit that electrically charges a surface of the electrophotographic photoreceptor, an exposing unit that exposes the surface of the electrophotographic photoreceptor electrically charged by the charging unit to form an electrostatic latent image, a developing unit that develops the electrostatic latent image using a developer including at least toner to form a toner image, and a transferring unit that transfers the toner image onto a recording medium.

14. An image forming apparatus comprising:

the electrophotographic photoreceptor of claim 1;

a charging unit that electrically charges a surface of the electrophotographic photoreceptor;

an exposing unit that exposes the surface of the electrophotographic photoreceptor electrically charged by the charging unit to form an electrostatic latent image;

a developing unit that develops the electrostatic latent image using a developer containing at least toner to form a toner image; and a transferring unit that transfers the toner image onto a recording medium.

* * * * *